US009060217B2

(12) United States Patent
Thormundsson et al.

(10) Patent No.: US 9,060,217 B2
(45) Date of Patent: Jun. 16, 2015

(54) AUDIO DRIVER SYSTEM AND METHOD

(75) Inventors: Trausti Thormundsson, Irvine, CA (US); Shlomi I. Regev, Irvine, CA (US); Govind Kannan, Corona Del Mar, CA (US); Harry K. Lau, Norwalk, CA (US); James W. Wihardja, Fullerton, CA (US); Ragnar H. Jonsson, Laguna Niguel, CA (US)

(73) Assignee: CONEXANT SYSTEMS, INC., Irvine, CA (US)

( * ) Notice: Subject to any disclaimer, the term of this patent is extended or adjusted under 35 U.S.C. 154(b) by 924 days.

(21) Appl. No.: 13/184,231

(22) Filed: Jul. 15, 2011

(65) Prior Publication Data

US 2012/0106750 A1 May 3, 2012

Related U.S. Application Data

(60) Provisional application No. 61/364,594, filed on Jul. 15, 2010.

(51) Int. Cl.

| | |
|---|---|
| ***G10K 11/16*** | (2006.01) |
| ***H04R 3/00*** | (2006.01) |
| ***H04R 29/00*** | (2006.01) |

(52) U.S. Cl.

CPC ..... *H04R 3/007* (2013.01); *H04R 29/003* (2013.01); *H04R 2499/11* (2013.01)

(58) Field of Classification Search

CPC ..... H04B 10/291; H04B 10/2912; H04B 10/2935; H04B 10/294; H04B 2210/003; H04B 10/2507; H04B 10/67; H04B 10/673; H04B 10/85; H04B 17/001; H04B 17/0037; H04B 3/06; H04B 7/005; H04N 5/211

USPC ..... 381/61, 66, 96–98, 101, 102–104, 107, 381/108, 111, 122, 94.1–94.4, 71.1–74.1, 381/71.12–71.14; 700/94

See application file for complete search history.

(56) References Cited

U.S. PATENT DOCUMENTS

| | | | |
|---|---|---|---|
| 4,495,640 A | 1/1985 | Frey | |
| 5,528,695 A | 6/1996 | Klippel | |

(Continued)

FOREIGN PATENT DOCUMENTS

| | | | | |
|---|---|---|---|---|
| EP | 1798852 A2 | | 6/2007 | |
| JP | 06-085576 | * | 3/1994 | ..... H03F 1/34 |

(Continued)

OTHER PUBLICATIONS

Klippel Wolfgang: "Measurement of Impulsive Distortion, Rub and Buzz and other Disturbances", 114th Convention of the AES, Mar. 22-25, 2003 XP040372109.*

(Continued)

*Primary Examiner* — Lun-See Lao

(74) *Attorney, Agent, or Firm* — Haynes and Boone, LLP

(57) ABSTRACT

A system and apparatus for constructing a displacement model across a frequency range for a loudspeaker is disclosed. The resultant displacement model is centered around the distortion point. Once a distortion model is constructed it can be incorporated into an audio driver to prevent distortion by incorporating the model and a distortion compensation unit with a conventional audio driver. Various topologies can be used to incorporate a distortion model and distortion compensation unit into an audio driver. Furthermore, a wide variety of distortion compensation techniques can be employed to avoid distortion in such an audio driver.

19 Claims, 41 Drawing Sheets

(56) References Cited

U.S. PATENT DOCUMENTS

| | | | | |
|---|---|---|---|---|
| 5,729,611 | A * | 3/1998 | Bonneville | 381/55 |
| 6,058,195 | A | 5/2000 | Klippel | |
| 6,201,873 | B1 * | 3/2001 | Dal Farra | 381/100 |
| 6,535,846 | B1 | 3/2003 | Shashoua | |
| 6,584,204 | B1 * | 6/2003 | Al-Ali et al. | 381/96 |
| 2002/0159605 | A1 | 10/2002 | Yoshino et al. | |
| 2004/0071299 | A1 | 4/2004 | Yoshino | |
| 2005/0276425 | A1 | 12/2005 | Forrester et al. | |
| 2008/0152168 | A1 | 6/2008 | Magrath | |
| 2010/0061564 | A1 * | 3/2010 | Clemow et al. | 381/71.6 |

FOREIGN PATENT DOCUMENTS

| | | | |
|---|---|---|---|
| KR | 1020050052347 | A | 6/2005 |
| KR | 1020050098113 | A | 10/2005 |
| WO | 2007/076299 | | 7/2007 |

OTHER PUBLICATIONS

The International Bureau of WIPO; International Preliminary Report on Patentability; PCT Application No. PCT/US2011/044068, Jan. 24, 2013.

The International Bureau of WIPO; International Preliminary Report on Patentability; PCT Application No. PCT/US2011/044242, Jan. 24, 2013.

Korean Intellectual Property Office; International Search Report; PCT Application No. PCT/US2010/025282; Oct. 13,2010.

Korean Intellectual Property Office; Written Opinion; PCT Application No. PCT/US2010/025282; Oct. 13, 2010.

Korean Intellectual Property Office; International Preliminary Report on Patentability; PCT Application No. PCT/US2010/025282; Oct. 13, 2010.

European Patent Office; Supplementary European Search Report; European Application No. 10746794.6, Apr. 23, 2012.

Klippel, Wolfgang; Measurement of Impulsive Distortion, Rub and Buzz and other Disturbances; 114th Convention of the AES; Mar. 22, 2003, 10 pages.

European Patent Office; Invitation to Pay Additional Fees; PCT Application No. PCT/US2011/044242, Oct. 12, 2011.

European Patent Office; Invitation to Pay Additional Fees; PCT Application No. PCT/US2011/044068, Sep. 27, 2011.

European Patent Office; International Search Report and Written Opinion; PCT Application No. PCT/US2011/044068, Dec. 9, 2011.

European Patent Office; International Search Report and Written Opinion; PCT Application No. PCT/US2011/044242, Jan. 26, 2012.

* cited by examiner

AUDIO DRIVER SYSTEM AND METHOD

RELATED APPLICATIONS

This application claims priority to U.S. Provisional patent application No. 61/364,594, filed Jul. 15, 2010, which is hereby incorporated by reference for all purposes, and is related to U.S. patent application Ser. No. 12/712,108, filed Feb. 24, 2010; U.S. provisional Patent application 61/360,720, filed Jul. 1, 2010; and U.S. provisional Patent application 61/364,706, filed Jul. 15, 2010.

TECHNICAL FIELD

This disclosure relates generally to audio drivers and specifically to the design and use of a displacement model centered around a distortion point for an audio driver.

BACKGROUND OF THE INVENTION

Loudspeakers under certain conditions are susceptible to a variety of forms of distortion. Loudspeaker distortion can be irritating to a listener. For example, "rub and buzz" distortion occurs when a loudspeaker cone hits a part of the loudspeaker. This occurs when the inward displacement of the loudspeaker cone is too great. This distortion in application such as cell phones can lead to not only poor quality reproduction, but can be so bad that the speech is unintelligible. With the movement towards smaller and cheaper loudspeakers in today's consumer electronics, the problem is only exacerbated.

At present, loudspeakers are at best measured for distortion in the factory and those that don't meet specifications are simply discarded.

SUMMARY OF THE INVENTION

A system and apparatus for constructing a displacement model across a frequency range for a loudspeaker is disclosed. The resultant displacement model is centered around a distortion point.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
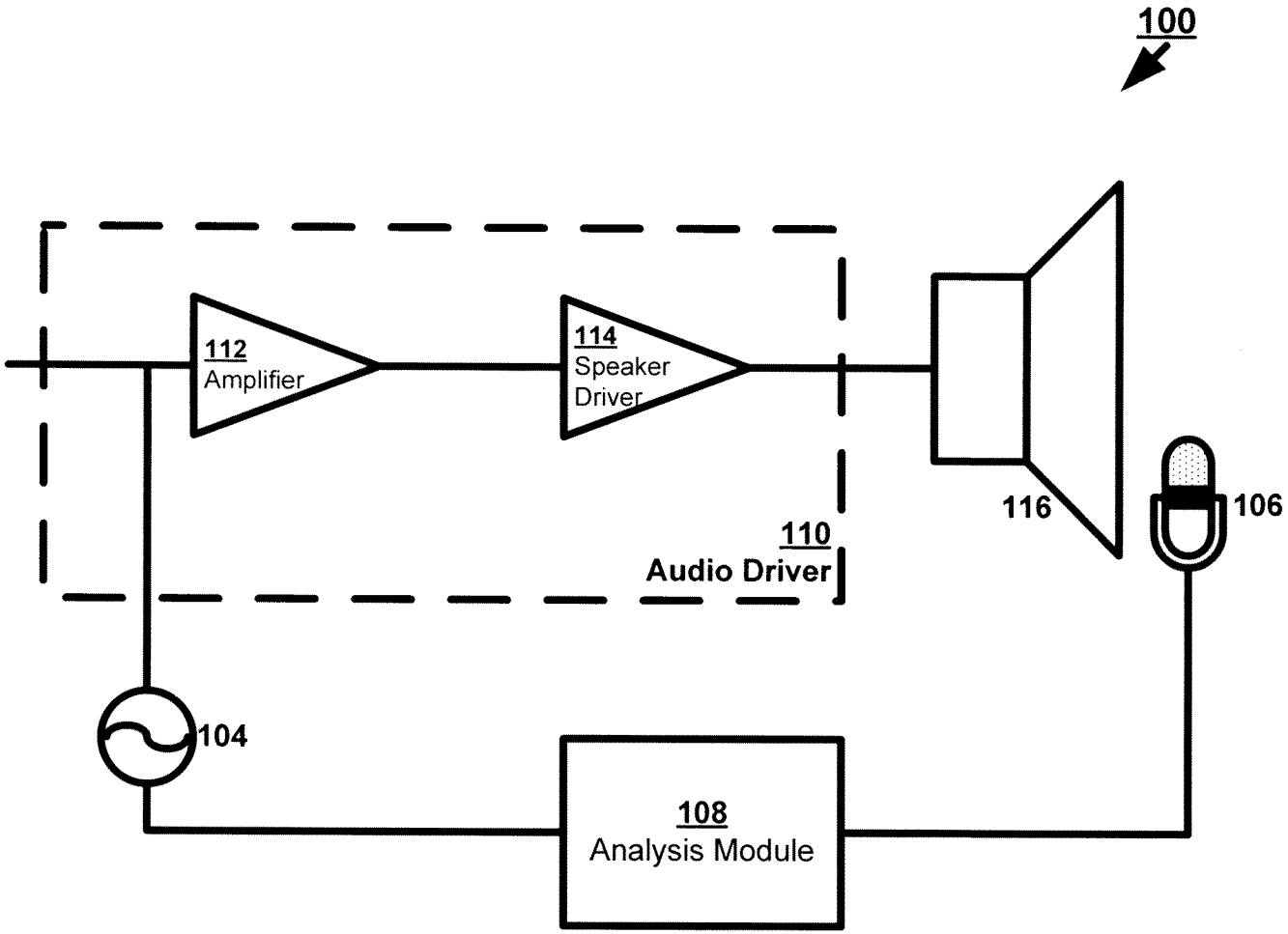
FIG. 1 shows an embodiment of a system for constructing a displacement model centered at a distortion point.

In the description that follows, like parts are marked throughout the specification and drawings with the same reference numerals. The drawing figures might not be to scale and certain components can be shown in generalized or schematic form and identified by commercial designations in the interest of clarity and conciseness.

A displacement model can be used to predict the onset of distortion and enable a compensation module to correct for the potential distortion before it occurs. While displacement models have been used in the past, they have been constructed using loudspeaker specifications which provide physical parameters that are intended for use in the linear region of a loudspeaker's operation. Models built using these specifications can deviate significantly from actual displacement as seen near the distortion point, leading either to allowing distortion to occur or to prematurely compensating for distortion, which could limit the amount of loudness permitted by the audio system.

Another drawback of using loudspeaker specifications is that the model constructed would not account for variations between loudspeakers. Another method of developing a displacement model for a loudspeaker is to physically measure the displacement of the loudspeaker. However, the instrumentation that is typically required to physically measure loudspeaker displacement is very costly, and this approach would not be practical in the situations where the need is greatest, that is, for inexpensive loudspeakers.

Embodiments of systems and methods for constructing a displacement model centered about a distortion point are described first. Subsequently, embodiments of an audio driver comprising the distortion model with different exemplary compensation options are disclosed.

An apparatus for constructing a displacement model across a frequency range for a loudspeaker can include an audio driver coupled to the loudspeaker, a signal generator coupled to the audio driver, a microphone and an analysis module. The analysis module steps through a vulnerable frequency range. At each frequency step, the analysis module selects an amplitude and uses a signal generator to generate a known signal. The signal is converted to sound by the loudspeaker and received by the microphone. The amplitude is increased until distortion is detected. When distortion is detected, the analysis module records the phase and the amplitude. The phase can be determined at an amplitude before distortion is detected. After the frequency range is scanned, each phase and magnitude is converted to a complex sample. An inverse transfer function is constructed by fitting the complex samples to an infinite impulse response (IIR) filter. This transfer function is then inverted, producing an IIR filter model of the displacement near the distortion point.

In one embodiment, distortion is determined by predicting the signal to be received by the microphone and comparing the expected signal with the actual signal received. If the signals deviate, then distortion has been detected. In one embodiment, a linear predictive filter is used to generate the expected signal. This linear predictive filter can be trained on signals generated by the signal generator at low amplitudes where distortion is not expected.

Once a distortion model is constructed, it can be incorporated into an audio driver to prevent distortion by incorporating the model and a distortion compensation unit with a conventional audio driver. Several topologies are possible. In one embodiment, the distortion model receives the output of the distortion compensation unit and feeds back a signal indicating the presence or absence of distortion to the distortion compensation unit. In another embodiment, the distortion model receives the input of the distortion compensation unit and feeds forward a signal indicating the presence or absence of distortion to the distortion compensation unit. In addition, in the case of displacement related distortion, the model can also supply the predicted loudspeaker displacement.

In another embodiment involving displacement related distortion, a displacement model can be used to convert the audio signal into a displacement signal. The distortion compensation unit operates on the displacement signal rather than the audio signal. The compensated displacement is then converted back to audio signal by an inverse filter to the displacement model.

In another embodiment, the audio driver can further comprise a distortion detection unit coupled to a microphone to detect actual distortion. When actual distortion occurs which is not predicted, the model can be revised either by changing a threshold or by recalibrating and building a new model using a signal generator and an analysis module.

In another embodiment, distortion is detected by using a resistor in series with the loudspeaker. The voltage signal measured across the resistor can be analyzed to detect distortion.

A wide variety of suitable distortion compensation units as disclosed herein can be employed. In one embodiment, the distortion compensation unit comprises a dynamic range compressor. In another embodiment, the distortion compensation unit comprises a gain element with an automatic gain control. In yet another embodiment, the distortion compensation unit comprises a look ahead peak reducer. In yet another embodiment, the distortion compensation unit comprises an adder operable to add a DC offset or a low frequency signal. In yet another embodiment, the distortion compensation unit comprises a PID controller. In yet another embodiment, the distortion compensation unit comprises a gain element with automatic gain control and an adder operable to add a DC offset or a low frequency signal. In yet another embodiment, the distortion compensation unit further comprises a PID controller operable to control the adder and the gain element. In yet another embodiment the distortion compensation unit further comprises a dynamic range compressor.

Phase modification can also be used in a distortion compensation unit in one embodiment. In another embodiment, the phase modification circuit only modifies the phase of the worst offending tracks.

In still another embodiment, the distortion compensation unit comprises a fast Fourier transform (FFT), an analysis module, an attenuation bank, and an inverse FFT. The FFT converts the audio signal into frequency components. The analysis module determines the worst offending frequency components and uses the attenuation bank to suppress the worst offenders.

In still another embodiment, the distortion compensation unit comprises a filter bank, a root-mean-square (RMS) estimator bank, an analysis module, an attenuation bank, and a synthesis bank. The filter bank separates the input signal into frequency bands, the RMS estimator estimates the energy in each of the frequency bands and the analysis module determines the worst offending frequency bands. The analysis module then suppresses the worst offenders by attenuating those frequency bands with an attenuation bank.

In still another embodiment, the distortion compensation unit further comprises a FFT or filter bank, an analysis module, a dynamic equalizer comprising one or more equalizer units. The filter bank or FFT extracts individual frequency components and the analysis module determines the worst offenders and sets the center frequency of each equalizer unit to the worst offending frequencies.

In still another embodiment, the center frequencies and optionally the attenuation of each equalizer unit is set by a PID controller. In this and other previously mentioned embodiments, the distortion compensation unit can also comprise a virtual bass unit which introduces virtual bass to the frequencies that were suppressed.

In another embodiment, each equalizer is equipped with a virtual bass unit. The virtual bass unit comprises a band pass filter which is complementary to the band stop filter in the equalizer. The suppressed frequency components are doubled, tripled or even quadrupled to provide a virtual bass effect to fill in for the suppressed frequency.

In many of the embodiments previously described a multiplexer can be used to bypass the active portions of the distortion compensation unit when no distortion is detected, thereby saving resources.

In another embodiment, the dynamic range compression techniques described above can also be used to increase the perception of loudness in an audio signal even when the audio signal is not near a distortion point.

FIG. 1 shows an embodiment of a system for constructing a displacement model centered at a distortion point. System 100 comprises audio driver 110 comprising amplifier 112, loudspeaker driver 114, loudspeaker 116, signal generator 104, microphone 106, and analysis module 108. Loudspeaker 116 is the loudspeaker for which the displacement model is to be constructed. Signal generator 104 generates waveforms of predetermined shape and frequencies under the control of analysis module 108, which compares the signal generated by signal generator 104 with the signal received at microphone 106. Audio driver 110 is typical of the analog portion of audio drivers. Suitable variations in the design of audio drivers, including combining amplifier 112 with loudspeaker driver 114, as well as the inclusion of additional circuitry such as anti-pop circuits, are intended to be covered by this disclosure.

Figure 2:
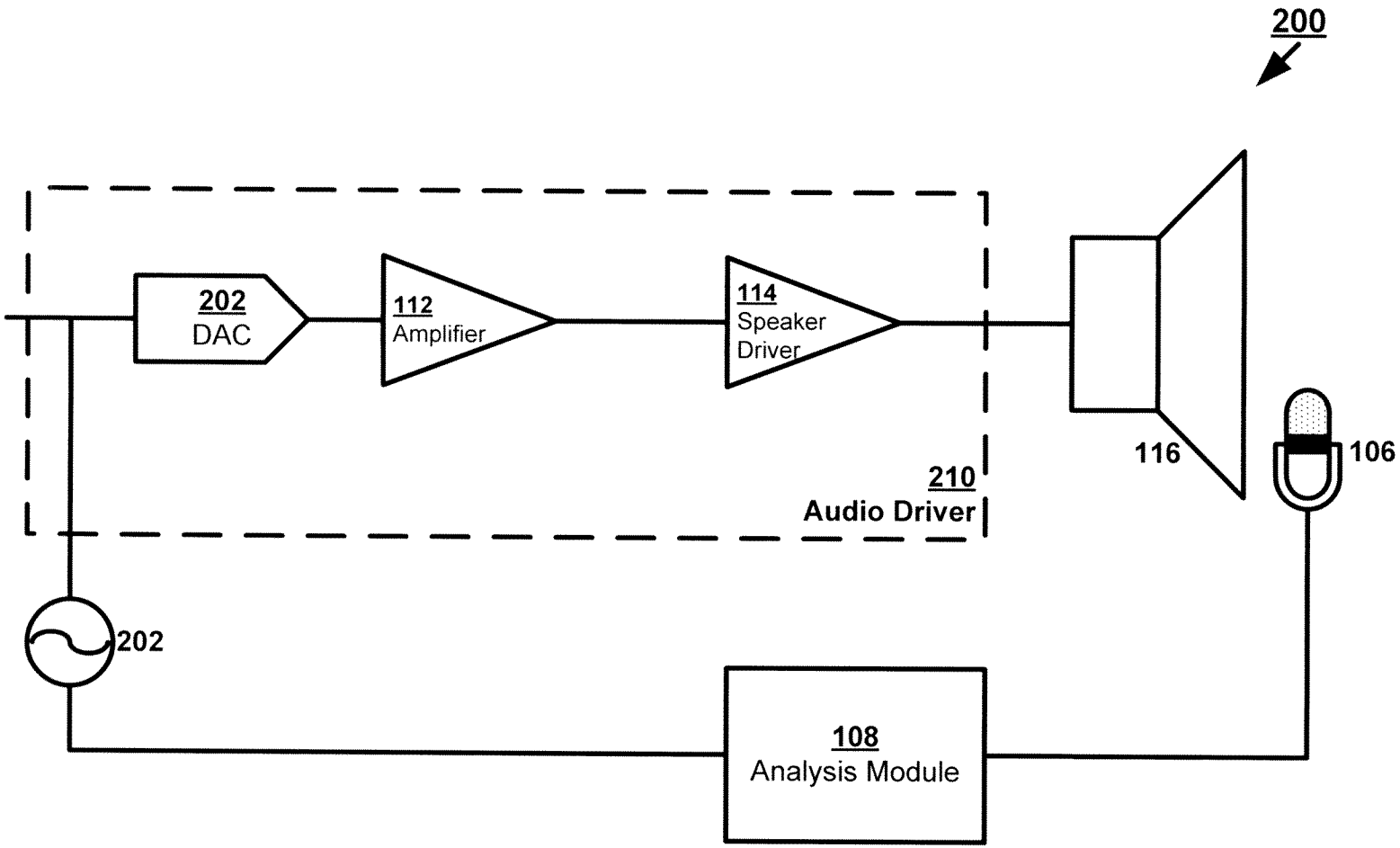
FIG. 2 shows another embodiment of a system for constructing a displacement model centered at a distortion point.

FIG. 2 shows another embodiment of a system for constructing a displacement model centered at a distortion point. System 200 comprises digital audio driver 210 which is similar to audio driver 110, except that it further comprises digital to analog converter (DAC) 202. System 200 comprises loudspeaker 116, digital signal generator 202, microphone 106 and analysis module 108. Digital signal generator 202 functions similarly to signal generator 104, except the signals are generated digitally.

Figure 3:
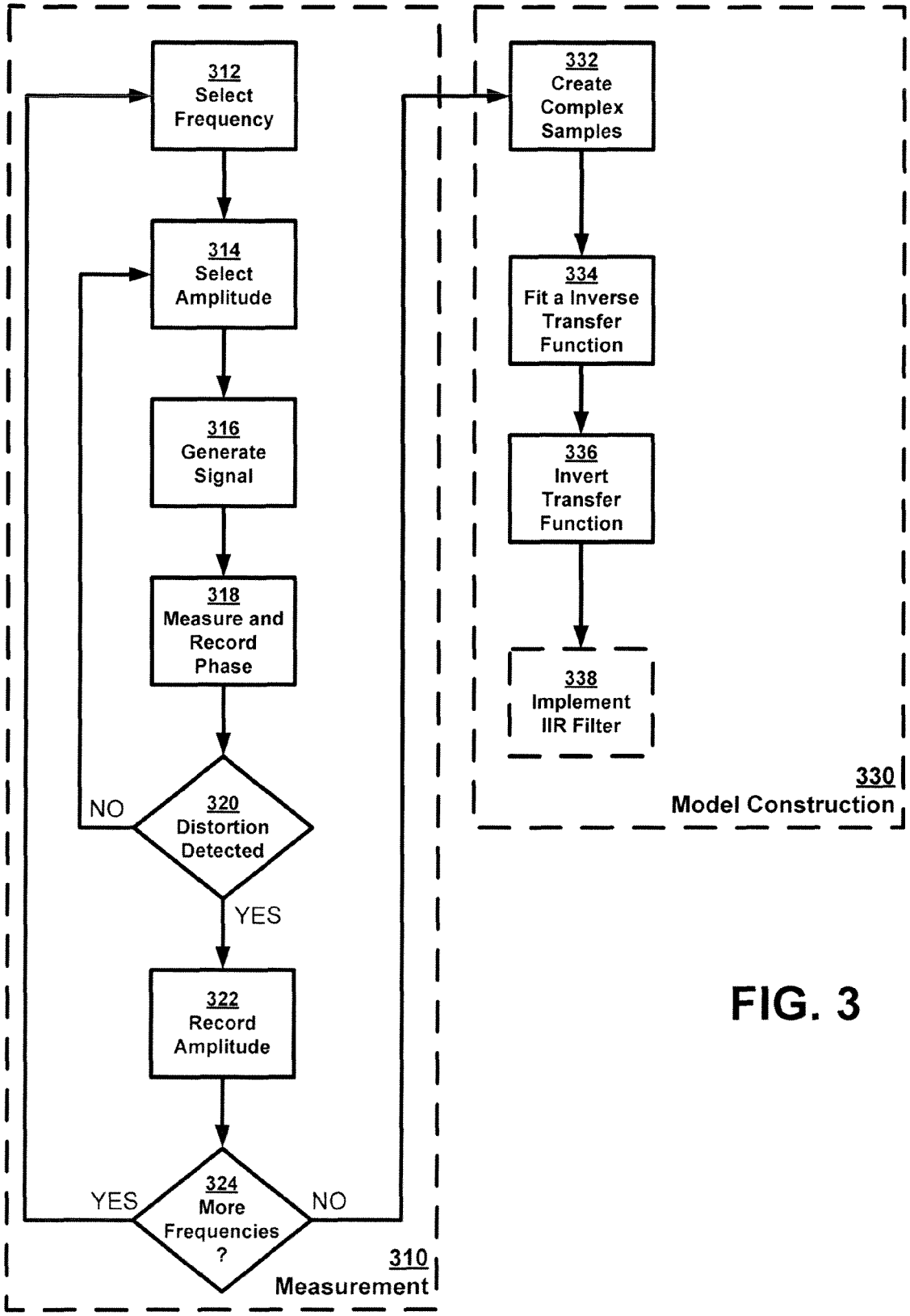
FIG. 3 is a flowchart illustrating the operation of an analysis module.

FIG. 3 is a flowchart illustrating the operation of analysis module 108. The operation comprises two main components; a measurement or calibration stage, shown by box 310, and an analysis or model building stage, shown by box 330. The measurement stage iterates through a collection of frequencies vulnerable to distortion, and for each of those frequencies, increases the magnitude of the signal until distortion is experienced. Specifically, at step 312 a frequency is selected, and at step 314, an amplitude is selected. At step 316, analysis module 108 causes signal generator 104 (or 202) to generate a sine wave with the selected amplitude and selected frequency. The amplitude is proportional to the voltage supplied by the audio driver to the loudspeaker. At step 318, the phase difference of the signal received at the microphone and the generated signal is recorded. At step 320, analysis module 108 determines whether there is distortion. If distortion is present, the amplitude at which the distortion occurs is recorded at step 322. If distortion is not present, another amplitude is selected at step 314. If distortion is detected at step 320, analysis module 108 returns to step 302 unless at step 324 it is determined that all relevant frequencies have been selected. Typically, in the selection of the frequency at step 312, a start frequency is first selected and upon subsequent iterations, that frequency is incremented. For example, the start frequency in a cellphone loudspeaker can be 200 Hz and this frequency are incremented by 10 Hz after each iteration.

Likewise, the selection of amplitude at step 314 can also be an iterative process, where a start amplitude for the selected frequency is selected and the amplitude is incremented or otherwise modified by a predetermined amount until distortion is found. In addition at step 320, the amplitude used can be checked against a limit. If a limit is reached, no measurement for that frequency is recorded and the process proceeds to step 324. By placing a limit on the amplitude, a termination to the iteration is insured. Furthermore, a limit can prevent damage to the loudspeaker from excessive voltage.

Once measurements are taken, a displacement model is constructed. The absolute scale of the displacement is not important for the purposes of predicting distortion, as only the displacement relative to the distortion point is important. For example, if distortion occurs at a displacement of 2 mm, it is not important to know that the current displacement of the loudspeaker is 1 mm, only that it is halfway to the distortion point. Therefore, without loss of generality, the displacement model uses a scale where the displacement where distortion occurs is 1.0 per unit. Based on the measurements taken in the portion of the flowchart designated by box 310, the voltage (i.e., signal amplitude) which causes displacement where distortion is known for frequencies across the range of vulnerability can be determined. The range of vulnerability can vary based on the application. For example, for rub and buzz distortion in a cell phone, the range of vulnerability is 200 Hz to 600 Hz. Below 200 Hz, the cell phone audio driver does not produce any sound and above 600 Hz, the audio driver is incapable of generating a signal with enough power to induce rub and buzz distortion.

From the measurements gathered, a transfer function from displacement to voltage can be approximated. At step 332, for each frequency, the complex voltage at which 1.0 per unit displacement occurs is derived. The magnitude is the amplitude of the voltage generated by the signal generator, but the phase of the voltage relative to the phase of the displacement is derived from the measurement of the phase difference between the voltage and the signal received at the microphone at step 318. It is known that the sound pressure, which is recorded at the microphone, is proportional to the second derivative of the displacement. Therefore, the phase recorded at the microphone is equal to the phase of displacement shifted by 180 degrees. This relationship only holds true if the microphone is next to the loudspeaker. If the microphone is further away from the loudspeaker, then an additional phase factor for each frequency is introduced which can be corrected. This phase factor is a function of the microphone's distance to the loudspeaker and the wavelength of the signal, and can either be derived from a known distance measurement between the loudspeaker and the microphone, or can be determined from phase samples taken at step 318 before the distortion occurs. With the phase and the magnitude of the displacement known, a transfer function from displacement to voltage can be approximated at step 334, such as by a least squares fit.

As an example, a first order infinite impulse response filter can be used, which has a transfer function which can be generally expressed as $$G(z) = \frac{a + bz^{-1}}{1 + cz^{-1}}.$$

The best fitting coefficients for G(z) can be determined based on the complex voltages derived in step 332. At step 336, G(z) is inverted to yield a transfer function from voltage to displacement can be obtained. In general, any suitable filter can be used. In particular a higher order IIR could be used for greater accuracy.

Figure 4:
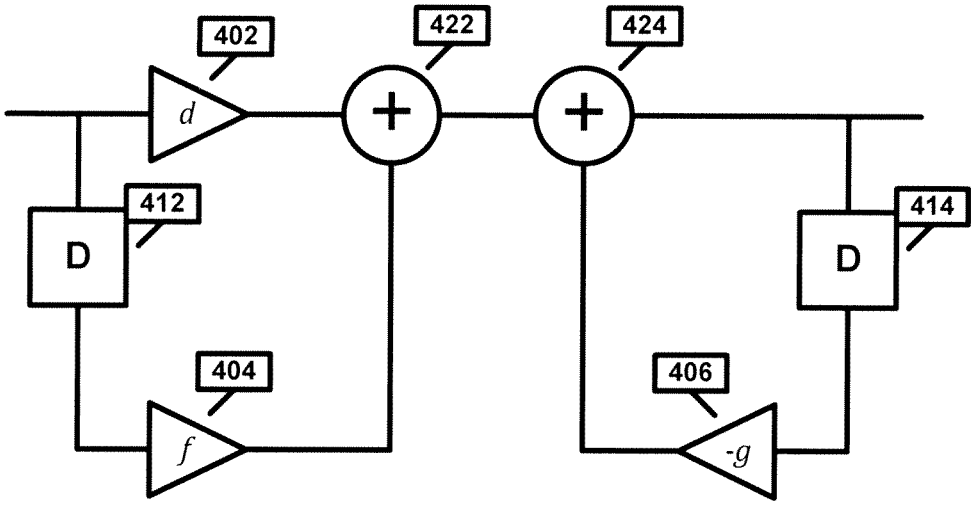
FIG. 4 illustrates an implementation of a typical first order digital IIR filter.

The model can simply be the transfer function or alternatively can be implemented by an IIR filter as indicated at step 338. FIG. 4 illustrates an implementation of a typical first order digital IIR with a transfer function $$H(z) = \frac{d + fz^{-1}}{1 + gz^{-1}}.$$

The IIR comprises gain elements 402, 404 and 406 which apply coefficients d, f and −g, respectively, delay lines 412, and 414, and signal summers 422 and 424, such as in a common implementation of a first order IIR. Additional gain elements and delay lines can be used to implement higher order IIRs.

Figure 5:
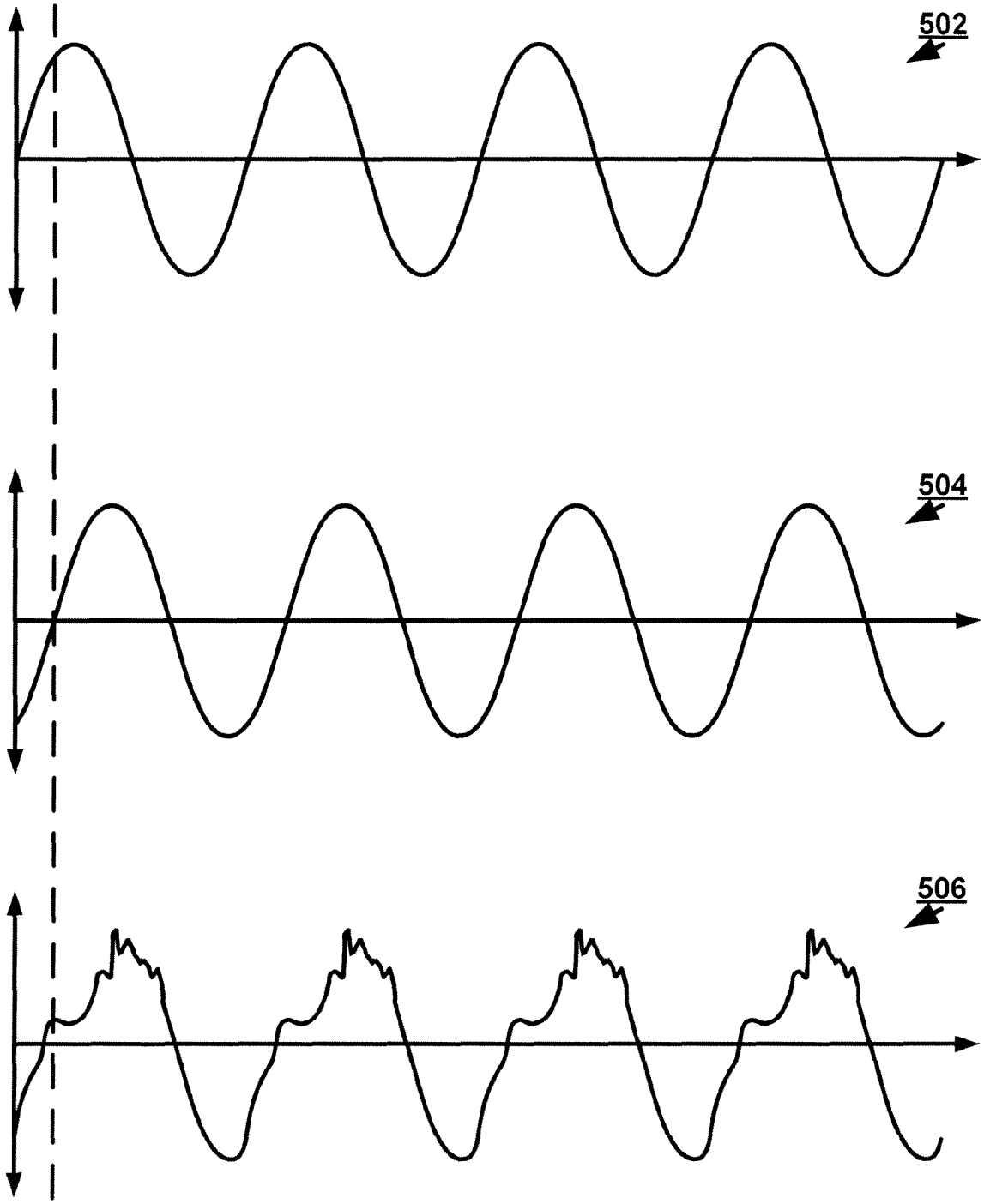
FIG. 5 shows exemplary waveforms exhibiting distortion.

Different methods for detecting whether distortion takes place can be used, depending on the type of distortion that takes place. For example, rub and buzz distortion takes place when the cone of a loudspeaker is impeded, such as by striking the bottom of the loudspeaker. As a result, the response to a sine wave appears clipped. FIG. 5 shows exemplary waveforms of input signals and corresponding rub and buzz distortion. Wave 502 is the input signal which is a sine wave. Wave 504 is the resultant sound wave if no distortion takes place. It may have a different amplitude and phase than wave 502 due to the overall transfer function of the audio system, but the wave form is a sine wave. Wave 506 shows a wave form exhibiting rub and buzz distortion. When the cone's movement is impeded the result is a very noticeable deviation from a sine wave. Therefore, comparing the waveform detected at the microphone and the expected waveform can yield an error measurement which can be used if to detect distortion. If the error exceeds a predetermined threshold then analysis module 108 determines that distortion has occurred.

In greater detail, an output signal is synthesized by matching an amplitude and phase based on the signal generated and the signal received by the microphone. Alternatively, a low order linear predictive filter can be used which is trained on samples already recorded from the microphone. The linear predictive filter can then synthesize the expected output signal. When the error exceeds a predetermined threshold then distortion can be inferred to exist. In practice, it has been found that when the error exceeds 25 dB that there is a high certainty of distortion existing.

It should be noted that the displacement model shown in FIG. 4 is a digital implementation of an infinite impulse response (IIR). An analog model can be used as well. Furthermore, the examples presented in the remainder of this disclosure employ digital signal processing, but analog embodiments can also or alternatively be used.

Figure 6:
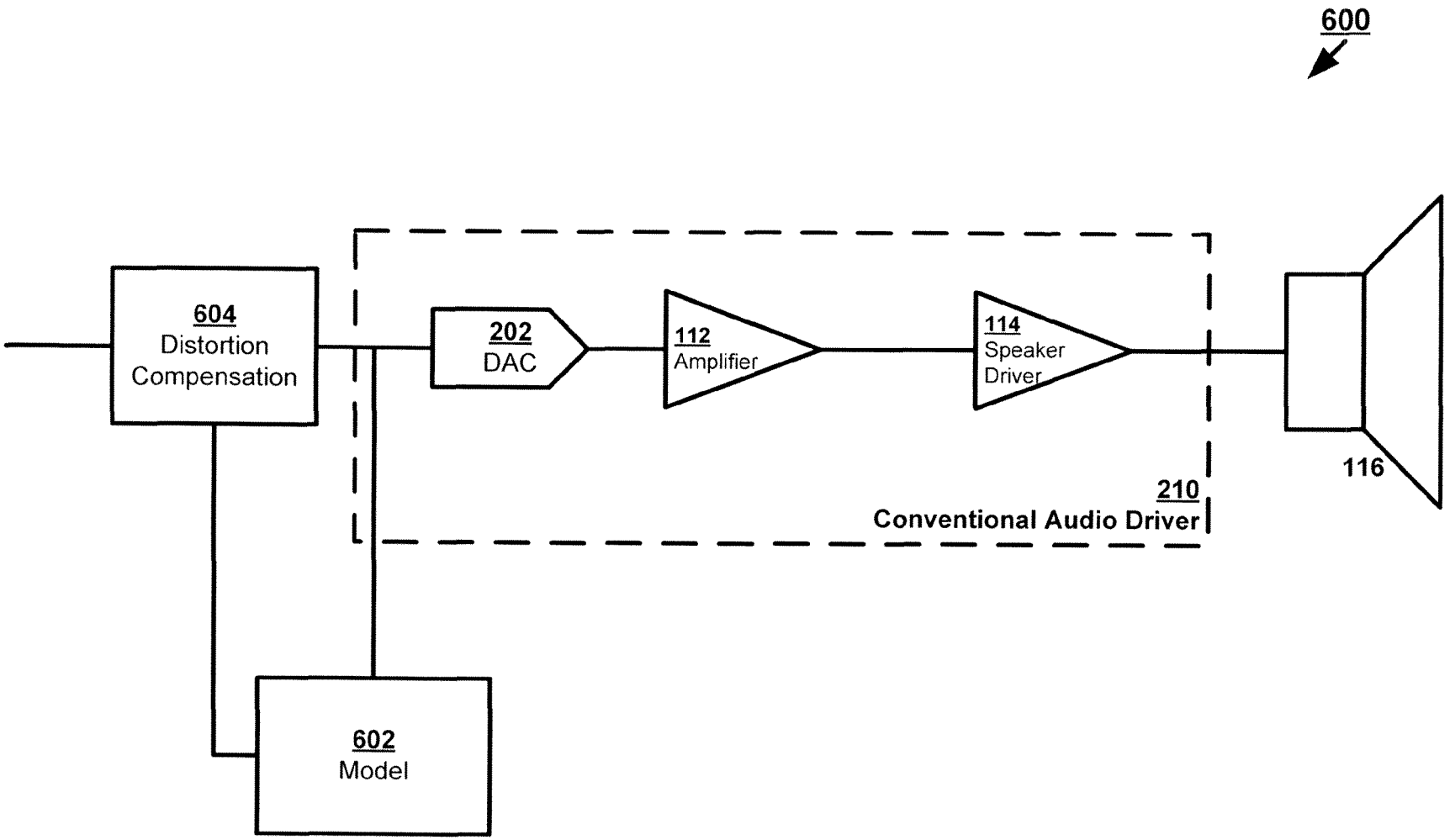
FIG. 6 shows an embodiment of an audio driver employing a displacement model.

FIG. 6 shows an embodiment of an audio driver employing a displacement model such as that described above. In addition to the components of a standard audio driver as indicated by box 210, audio driver 600 further comprises displacement model 602 and distortion compensation module 604. In this embodiment, displacement model 602 and distortion compensation module 604 are placed in a feedback configuration. The model taps digital audio signal prior to being received by DAC 202. Based on the signal value, displacement model 602 generates distortion related data and transmits it to distortion compensation module 604. The information comprises at least the loudspeaker displacement, but may also comprise a threshold level at which distortion takes place. In some embodiments, distortion compensation module may obtain the magnitude of each frequency at which distortion occurs. For example, this magnitude can be the value determined at step at 320 in FIG. 3 for each frequency in the vulnerable range.

One drawback of the feedback configuration is that once the model detects a displacement which can cause distortion, the distortion would have already occurred. For this reason, distortion compensation module 604 would have to be more predictive. For example, if the magnitude of the voltage begins to increase to the point where the threshold is approached, distortion compensation module 604 would then begin to apply distortion countermeasures prior to attaining the threshold.

Figure 7:
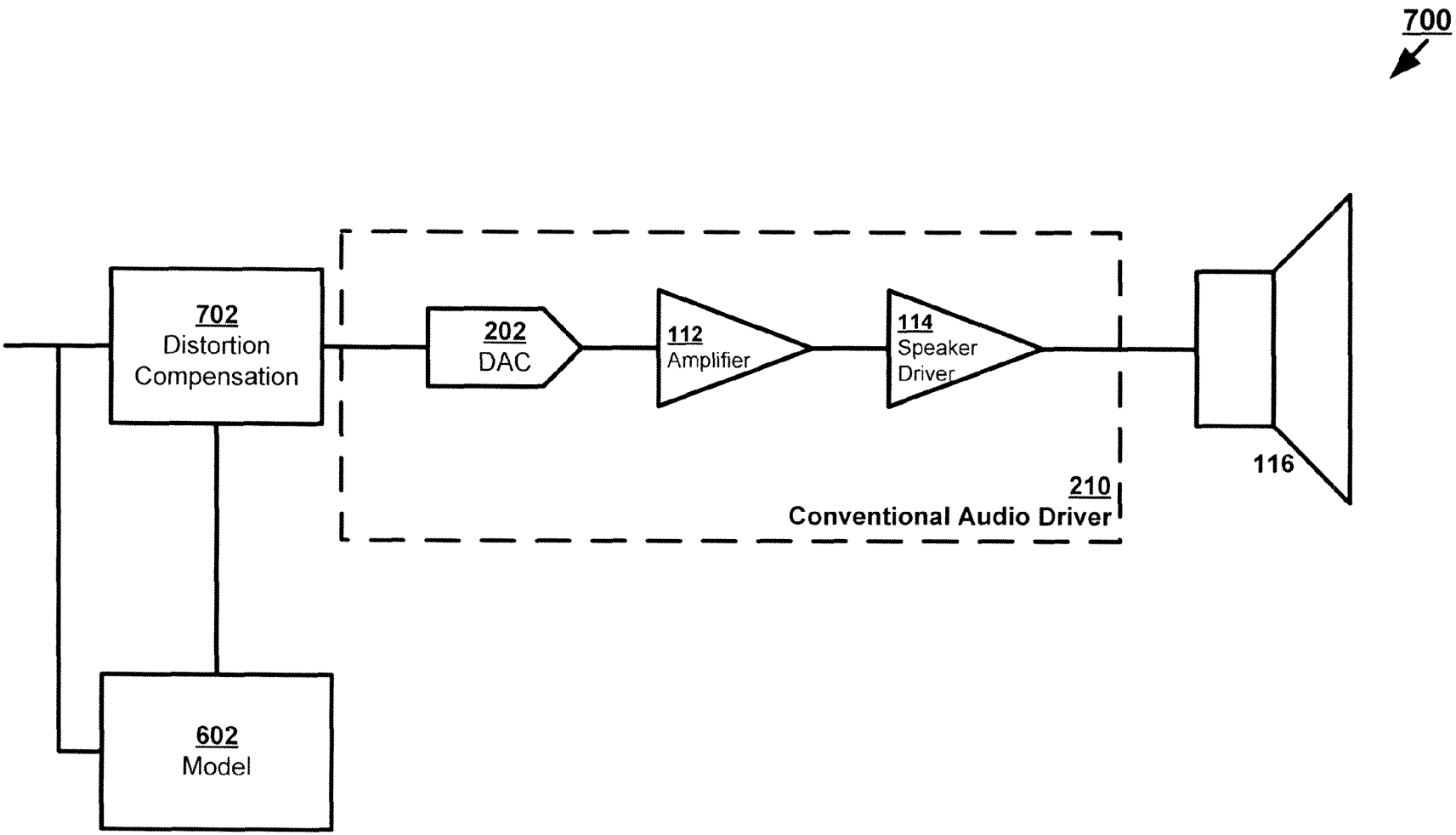
FIG. 7 shows an alternate embodiment of an audio driver employing a displacement model.

FIG. 7 shows an alternate embodiment of an audio driver employing a displacement model. In addition to the components of a standard audio driver as indicated by box 210, audio driver 700 further comprises displacement model 602 and distortion compensation module 702. In this embodiment, displacement model 602 and distortion compensation module 702 are placed in a feed forward configuration. The model taps digital audio signal prior to passing to distortion compensation module 702. This is a departure from audio driver 600 where the model taps the digital audio signal after passing through distortion compensation module 604. Based on the signal value, displacement model 602 generates distortion related data and transmits it to distortion compensation module 702. The information can include the loudspeaker displacement, a threshold level at which distortion takes place, or other suitable data. In some embodiments, distortion compensation module can obtain the magnitude of each frequency at which distortion occurs.

One advantage of the feed forward configuration is that the distortion is predicted by the model prior to the signal being provided to DAC 202. Distortion compensation module 702 does not need to predict future distortion. However, some compensation techniques can employ attack and release time to more smoothly implement distortion compensation and to minimize the audible artifacts. The drawback of the feed forward configuration is that the signal is delayed while distortion compensation module 702 processes the signal. However, typically this is a very short delay which is not perceivable to the listener.

Figure 8:
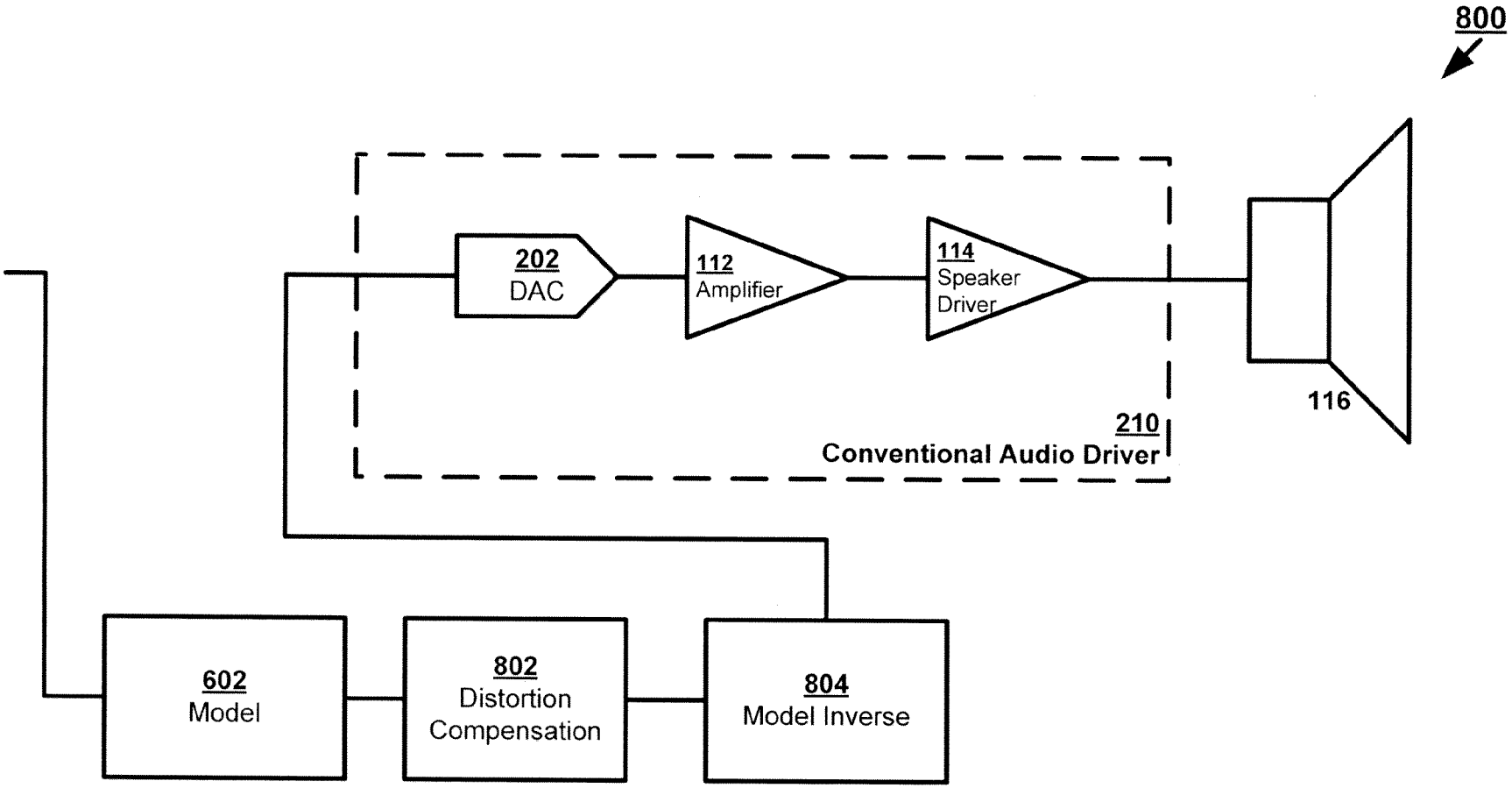
FIG. 8 shows another alternate embodiment of an audio driver employing a displacement model.

FIG. 8 shows another alternate embodiment of an audio driver employing a displacement model. In addition to the components of a standard audio driver as indicated by box 210, audio driver 800 further comprises displacement model 602, distortion compensation module 802, and model inverse 804. The advantage of this approach is that distortion compensation module 802 alters the displacement directly rather than the audio signal. In order to implement this audio driver, an inverse to displacement model 602 is used.

As described above, the displacement model can be modeled by an IIR filter. With a well defined transfer function, an inverse transfer function can easily be computed. However, the inverse transfer function can pose several practical challenges. First, the inverse model may no longer be causal (i.e., requiring future input values). To overcome the first obstacle, barring the ability to know future values, a look ahead of a few samples can be used. Another issue is the stability of the inverse transfer function, as an incorrect function can result in instability. The optimal inverse filters can provide an accurate approximation to an inverse filter across a frequency range and maintain stability. The accuracy of these optimal inverse filters can also depend on the model used. Additional embodiments are shown in terms of a feed forward configuration or a model inverse configuration.

Figure 9:
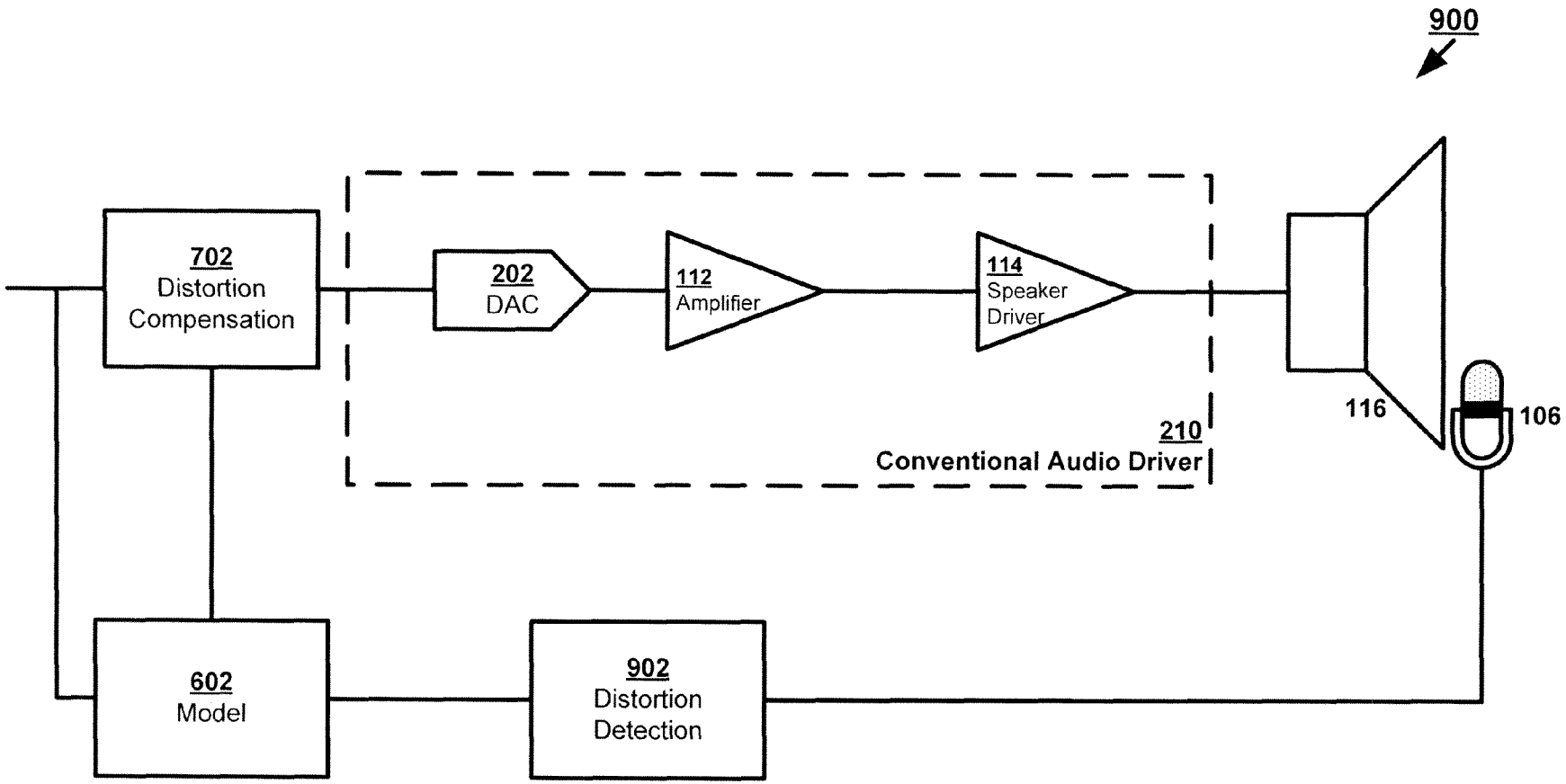
FIG. 9 shows another embodiment of an audio driver employing a displacement model.

FIG. 9 shows another embodiment of an audio driver employing a displacement model. Like audio driver 700, audio driver 900 employs displacement model 602, and distortion compensation module 702 in a feed forward configuration. In addition, it comprises microphone 106 and distortion detection module 902. This configuration is particularly useful in electronic devices where a native microphone is available, such as in a cellular telephone. Displacement model 602 and distortion compensation module 702 function as described above. In addition, distortion detection module 902 monitors the signal received at the microphone for the presence of distortion.

Rub and buzz distortion or other types of distortion can occur at a lower voltage than originally predicted by displacement model 602. For example, as a loudspeaker ages, components wear and the elasticity and stiffness of the various components change. When distortion is detected by distortion detection module 902, displacement model 602 is adjusted accordingly. As an example, the displacement threshold where rub and buzz distortion begins can be lowered. For example, by the way displacement model 602 is first computed, a displacement value of 1.0 is the point at which rub and buzz distortion takes place. However, if distortion is now detected when a displacement value of 0.95 occurs, displacement model 602 can set the threshold to a value under 0.95.

Unlike the measurement phase in FIG. 3, distortion detection module 902 looks for distortion in an active signal rather than in a calibration signal (such as a pure sine wave). Most types of distortion, such as rub and buzz distortion, exhibit a characteristic spectral pattern which is readily detectable.

Figure 10:
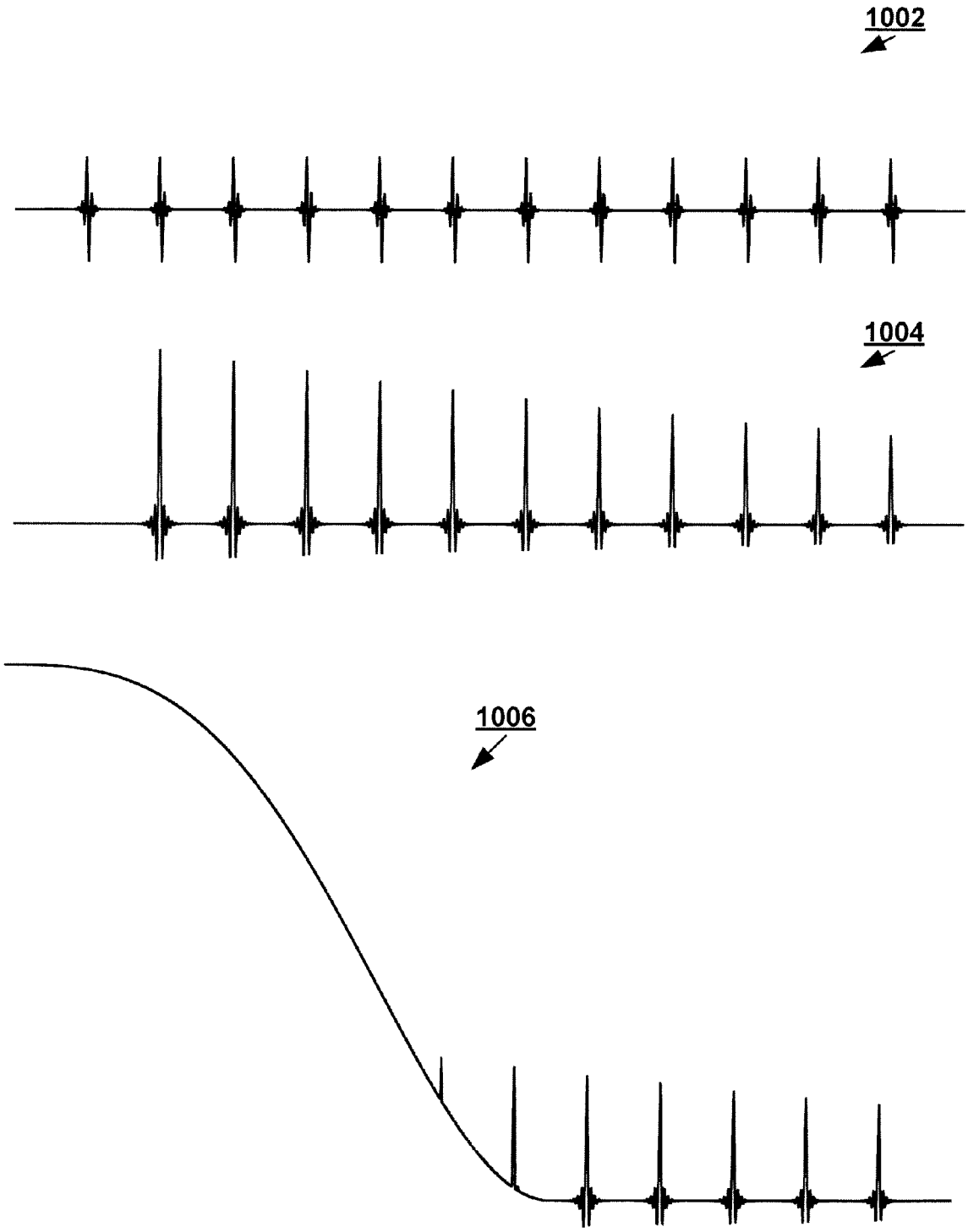
FIG. 10 shows an exemplary spectrum of rub and buzz distortion.

FIG. 10 shows an exemplary spectrum of rub and buzz distortion. Waveform 1002 shows a time domain signal characteristic of rub and buzz distortion that includes an impulse train. Waveform 1004 shows the harmonically rich spectrum characteristic of rub and buzz distortion; once again it resembles an impulse train. Waveform 1006 shows an exemplary spectrum with the presence of rub and buzz distortion. While the output signal can cover up the lower order harmonics of the rub and buzz distortion, the higher harmonics are still present. Even when natural signals are accompanied by harmonics, they tend to die off quickly, unlike the rub and buzz distortion which have more persistent higher harmonics. Therefore, some basic spectral analysis can detect the presence of rub and buzz distortion. As an example, the signal can be digitized, an FFT can be taken over a short window, and the distortion detection module 902 can look for a pattern of high harmonics.

Figure 11:
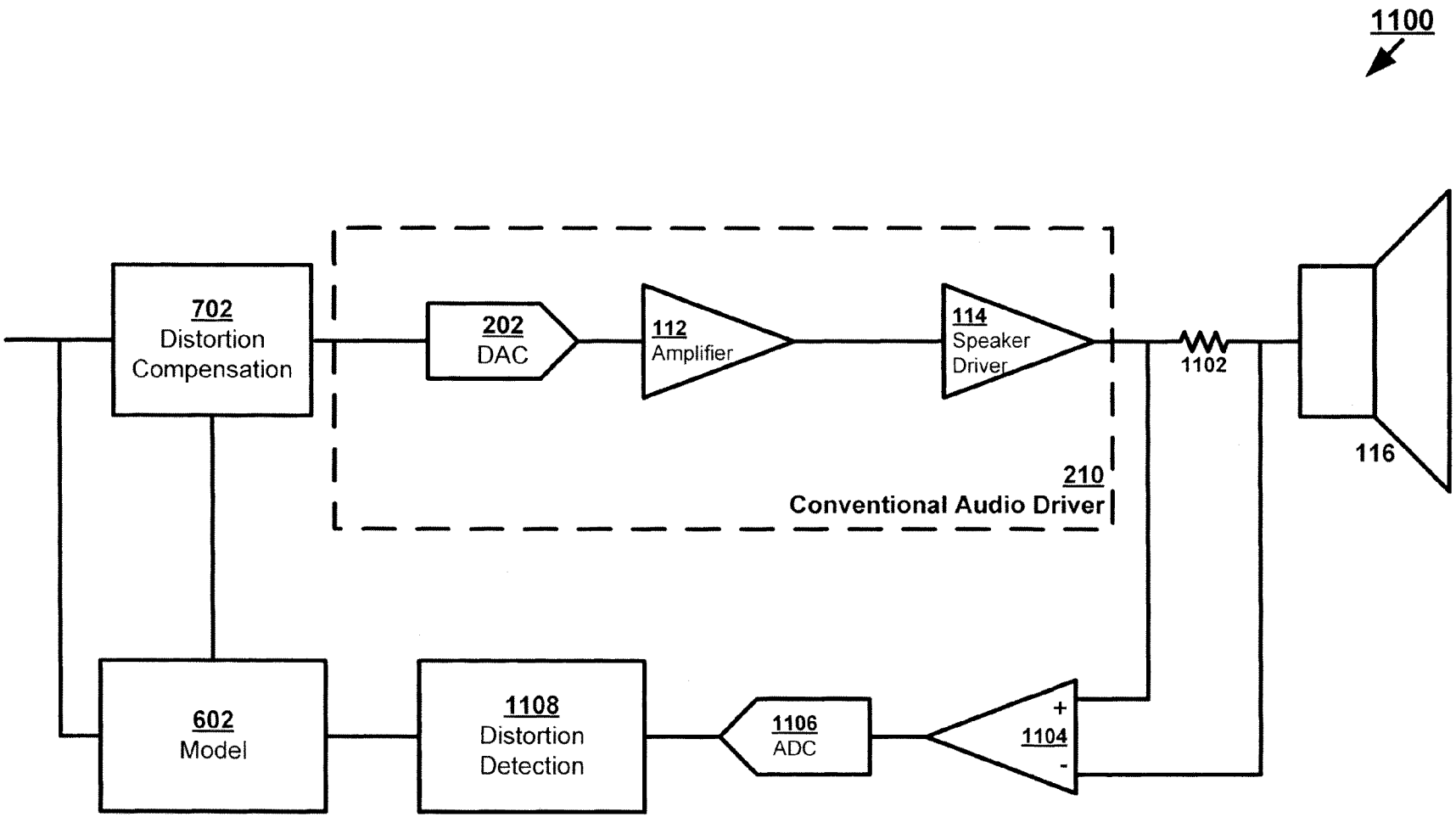
FIG. 11 shows still another embodiment of an audio driver employing a displacement model.

FIG. 11 shows still another embodiment of an audio driver employing a displacement model. Audio driver 1100 is similar to audio driver 900 except a microphone is not available. For electronic devices such as headsets or MP3 players that may not have a built-in microphone available, a loudspeaker can function as a crude microphone, where the current driving the loudspeaker can reflect the presence of distortion. To measure the current, audio driver 1100 includes resistor 1102 in series with loudspeaker 116. The voltage across resistor 1102 is proportional to the current flowing to loudspeaker 116. Differential amplifier 1104 converts the voltage difference to an absolute voltage and analog-to-digital converter (ADC) 1106 digitizes the voltage. The digitized voltage can then be analyzed by distortion detection module 1108. Distortion detection module 1108 can look for the same kind of spectral characteristics as distortion detection module 902. The precise logic can vary as the measured signal by microphone 106 and the current flowing to loudspeaker 116 have different characteristics. However, in both cases, rub and buzz distortion is very prominent spectrally.

If distortion is detected by distortion detection module 1108 despite the prediction of displacement model 602, displacement model 602 can be adjusted accordingly in a similar manner to that discussed above for audio driver 900.

Figure 12:
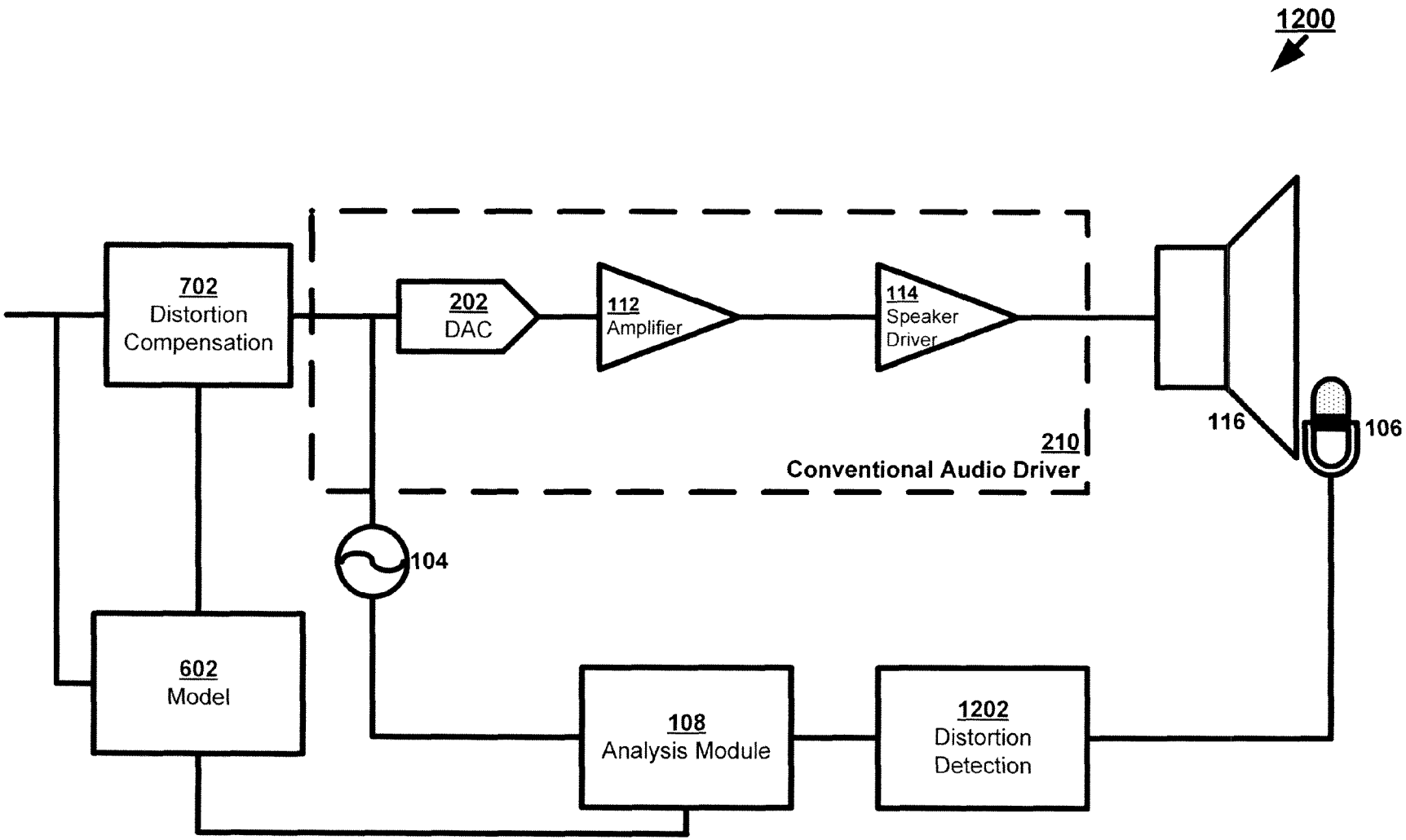
FIG. 12 shows yet another embodiment of an audio driver employing a displacement model.

FIG. 12 shows yet another embodiment of an audio driver employing a displacement model. Audio driver 1200 is similar to audio driver 900 in that it employs microphone 106 to detect distortion. Audio driver 1200 also comprises distortion detection module 1202 which can employ similar techniques to that used by distortion detection module 902 as described above. If distortion is detected that is not predicted by displacement model 602, distortion detection module 1202 can revise distortion model 602 to account for the new distortion point as described above, it can trigger a rebuilding of displacement model 602, or it can perform other suitable functions.

Several criteria can be used to determine whether displacement model 602 should be rebuilt. In some electronic devices such as cellular telephones, time is kept. It may be desirable to rebuild the model after a fixed period of time, such as every six months. Alternatively, an electronic device can elect to rebuild displacement model when the actual displacement where distortion occurs deviates from that predicted by displacement model exceeds a certain threshold. For example, a displacement of 1.0 per unit may initially indicate the onset of rub and buzz distortion, but after aging of the loudspeaker, rub and buzz distortion might observed at a displacement of 0.8 per unit.

If model rebuilding is indicated, audio driver 1200 returns to a calibration function where analysis module 108 generates a sequence of sine waves using signal generator 104 and compares it with the signal received by microphone 106. A new displacement model is built using the methods described above such as in FIG. 3. When a new displacement model is built, it replaces displacement model 602 and the electronic device/audio driver returns to normal function.

In another embodiment, microphone 106 is a built-in microphone which may be an uncalibrated lower quality microphone. Initially, displacement model 602 is built using a high quality calibrated microphone. Because the aging process of the loudspeaker will not likely effect all frequencies equally, the model rebuilding operation refines the current model by reconstructing the model at frequencies where the displacement model no longer fits well, while retaining the portion of the displacement model where the model still is accurate. This hybrid approach can account for loudspeaker aging while using a built-in microphone.

Thus far embodiments of displacement model building have been disclosed. Various configurations employing the displacement model have also been described. A wide variety of suitable compensation techniques can also be employed, as described below.

The audio drivers described above can be implemented as a separate driver or integrated into an electronic device such as a cellular telephone. They may also be implemented in software as part of the audio system in a personal computer.

Figure 13:
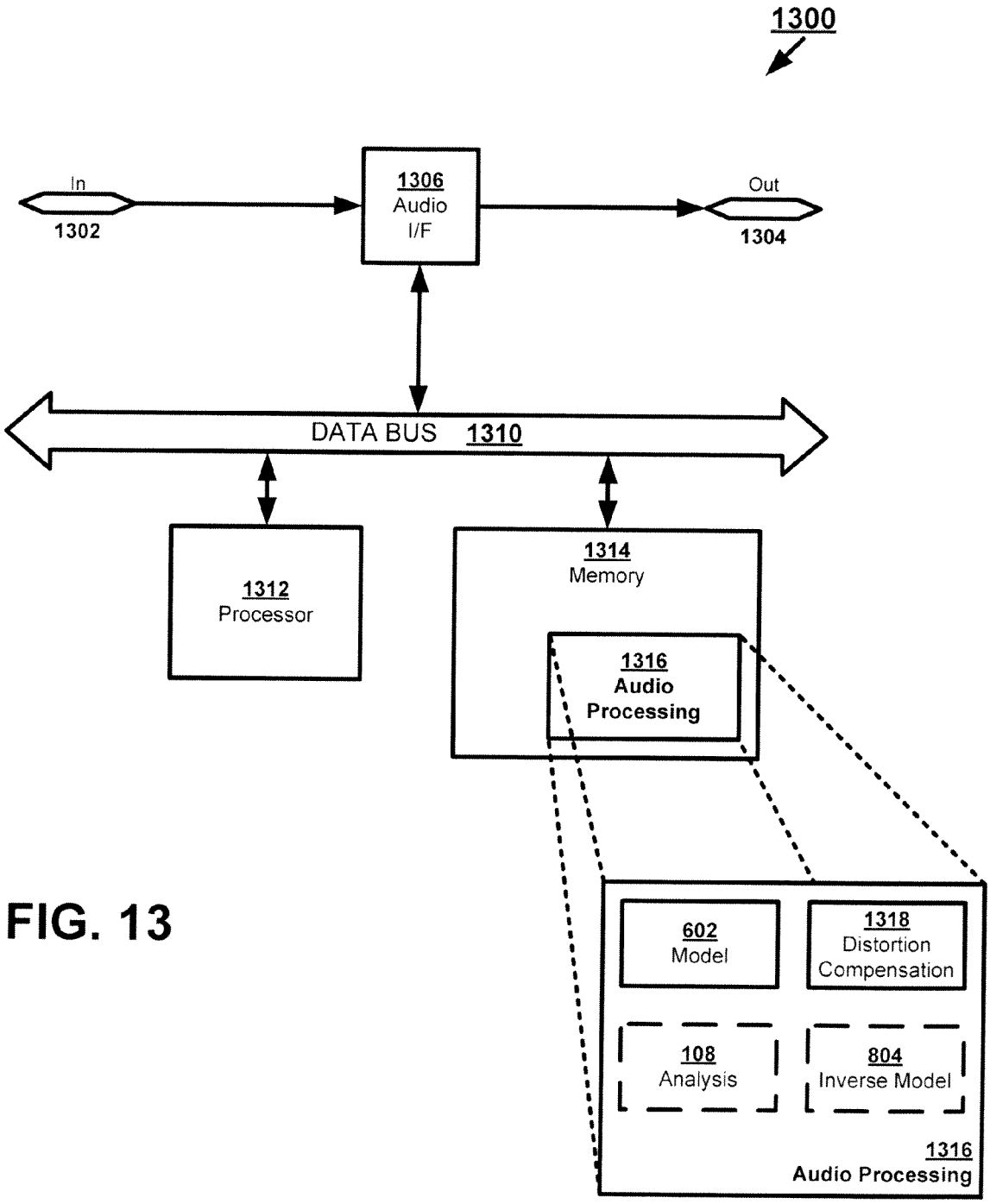
FIG. 13 is a diagram illustrating an embodiment of a digital front end to an audio driver.

FIG. 13 is a diagram illustrating an embodiment of a digital front end to an audio driver. In this implementation, digital front end comprises memory 1314, processor 1312, and audio interface 1306, wherein each of these devices is connected across one or more data buses 1310. Though the illustrative embodiment shows an implementation using a separate processor and memory, other embodiments include an implementation purely in software as part of an application, and an implementation in hardware using signal processing components.

Audio interface 1306 receives audio input data 1302, which can be provided by an application such as music or video playback application or cellular telephone receiver, and provides processed digital audio output 1304 to the backend of the audio driver, such as backend audio driver 210 in FIG. 2. Processor 1312 can include a central processing unit (CPU), an auxiliary processor associated with the audio system, a semiconductor based microprocessor (in the form of a microchip), a macroprocessor, one or more application specific integrated circuits (ASICs), discrete semiconductor devices, a digital signal processor (DSP) or other hardware for executing instructions.

Memory 1314 can include any one of a combination of volatile memory elements (e.g., random-access memory (RAM) such as DRAM, and SRAM) and nonvolatile memory elements (e.g., flash, read only memory (ROM), or nonvolatile RAM). Memory 1314 stores one or more separate programs, each of which includes an ordered listing of executable instructions for implementing logical functions to be performed by the processor 1312. The executable instructions include instructions for audio processing module 1316 including displacement model 602, a distortion compensation module 1318, which can be any of those described previously, and optionally analysis module 108 and model inverse 804. Audio processing module 1316 can also comprise instructions for performing audio processing operations such as equalization and filtering. In alternate embodiments, the logic for performing these processes can be implemented in hardware or a combination of software and hardware.

Cellular telephones are especially susceptible to peak induced distortion. Because of the low cost speakers usually employed to keep unit costs down, these speakers are more vulnerable to rub and buzz distortion than more expensive speakers.

Figure 14:
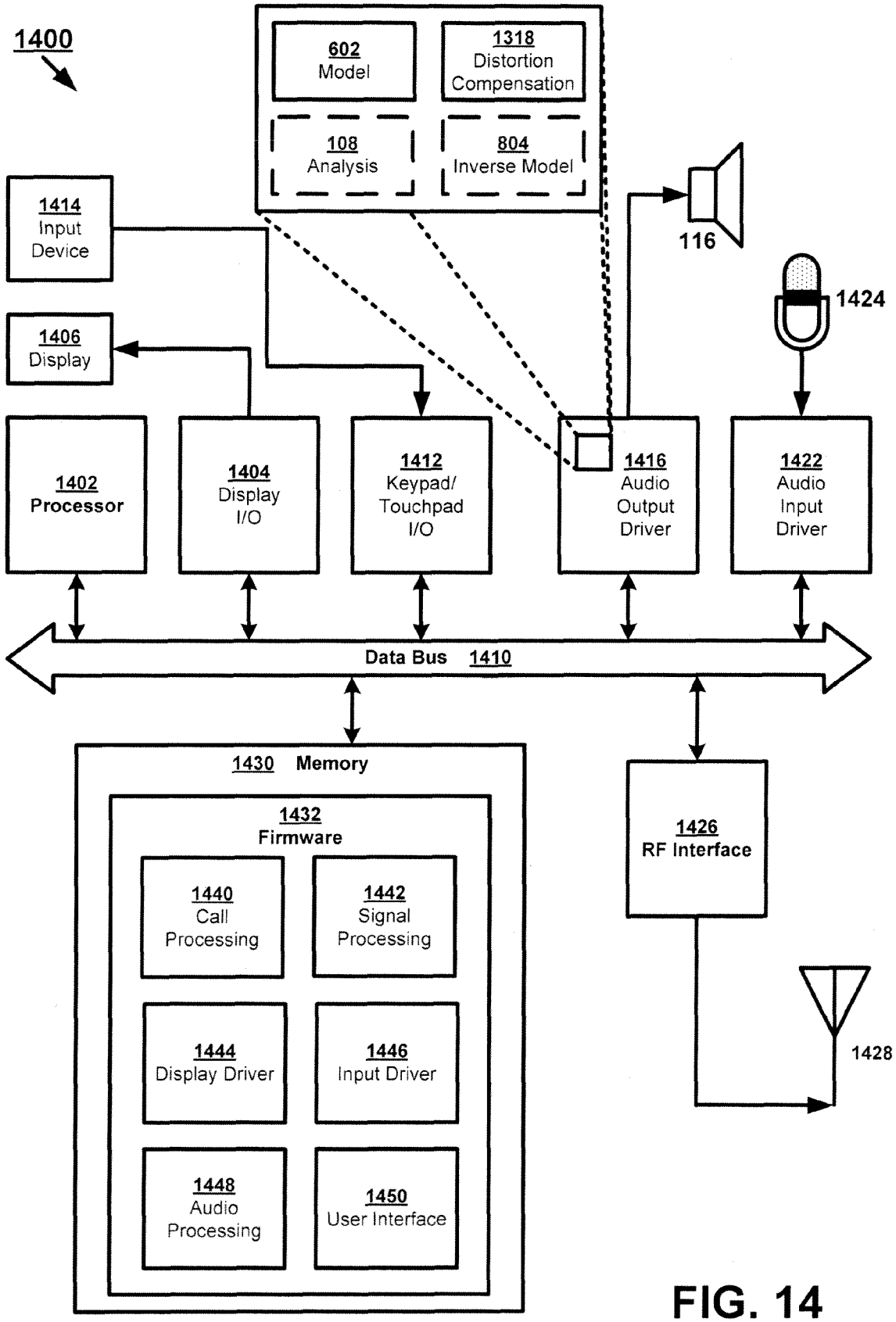
FIG. 14 is an embodiment of a cellular telephone equipped with distortion compensation.

FIG. 14 is an embodiment of a cellular telephone equipped distortion compensation. Cellular telephone 1400 comprises processor 1402, display I/O 1404, input I/O 1412, audio output driver 1416, audio input driver 1422, RF interface 1426 and memory, wherein each of these devices is connected across one or more data buses 1410.

Cellular telephone 1400 further comprises display 1406 which is driven by display I/O 1404. Display 1406 is often made from a liquid crystal display (LCD) or light emitting diodes (LED). Cellular telephone 1400 further comprises input device 1414 which communicates to the rest of the cellular telephone through input I/O 1412. Input device 1414 can be one of a number of input devices including keypad, keyboard, touch pad or combination thereof. Cellular telephone 1400 further comprises loudspeaker 116 which is driven by audio output driver 1416, microphone 1424 which drives by audio input driver 1422 and antenna 1428 which is sends and receives RF signals through RF interface 1426. Furthermore, audio output driver 1416 can comprise distortion model 602, a distortion compensation module 1318, which can be any of those described previously, and optionally analysis module 108 and model inverse 804.

Processor 1402 can include a CPU, an auxiliary processor associated with the audio system, a semiconductor based microprocessor (in the form of a microchip), a macroprocessor, one or more ASICs, digital logic gates, a DSP or other hardware for executing instructions.

Memory 1430 can include one or more volatile memory elements and nonvolatile memory elements. Memory 1430 stores one or more separate programs, each of which includes an ordered listing of executable instructions for implementing logical functions to be performed by processor 1402. The executable instructions include firmware 1432 which control and manage many functions of the cellular telephone. Firmware 1432 comprises call processing module 1440, signal processing module 1442, display driver 1444, input driver 1446, audio processing module 1448 and user interface 1450. Call processing module 1440 contains instructions that manage and control call initiation, call termination, and housekeeping operations during a call as well as other call related features such as caller id and call waiting. Signal processing module 1442 contain instructions that manage the communications between the cellular telephone and remote base stations when executed, including but not limited to determining signal strength, adjusting transmit strength and encoding of transmitted data. Display driver 1444 interfaces between user interface 1450 and display I/O 1404 so that the appropriate messages, text and annunciators can be shown on display 1406. Input driver 1446 interfaces between user interface 1450 and input I/O 1412, so that user input from input device 1414 can be interpreted by user interface 1450 and the appropriate actions can take place. User interface 1450 controls the interaction between the end user through display 1406 and input device 1414 and operation of the cellular telephone. For instance, when a phone number is dialed through input device 1414, user interface 1450 can cause "CALLING" to be displayed on display 1406. Audio processing module 1448 manages the audio data received from microphone 1424 and transmitted to loudspeaker 116. Audio processing module 1448 can include such features as volume control and mute functions. In alternate embodiments, the logic for performing these processes can be implemented in hardware or a combination of software and hardware. In addition, other embodiments of a cellular telephone can comprise additional features such as a Bluetooth interface and transmitter, a camera, and mass storage.

Figure 15:
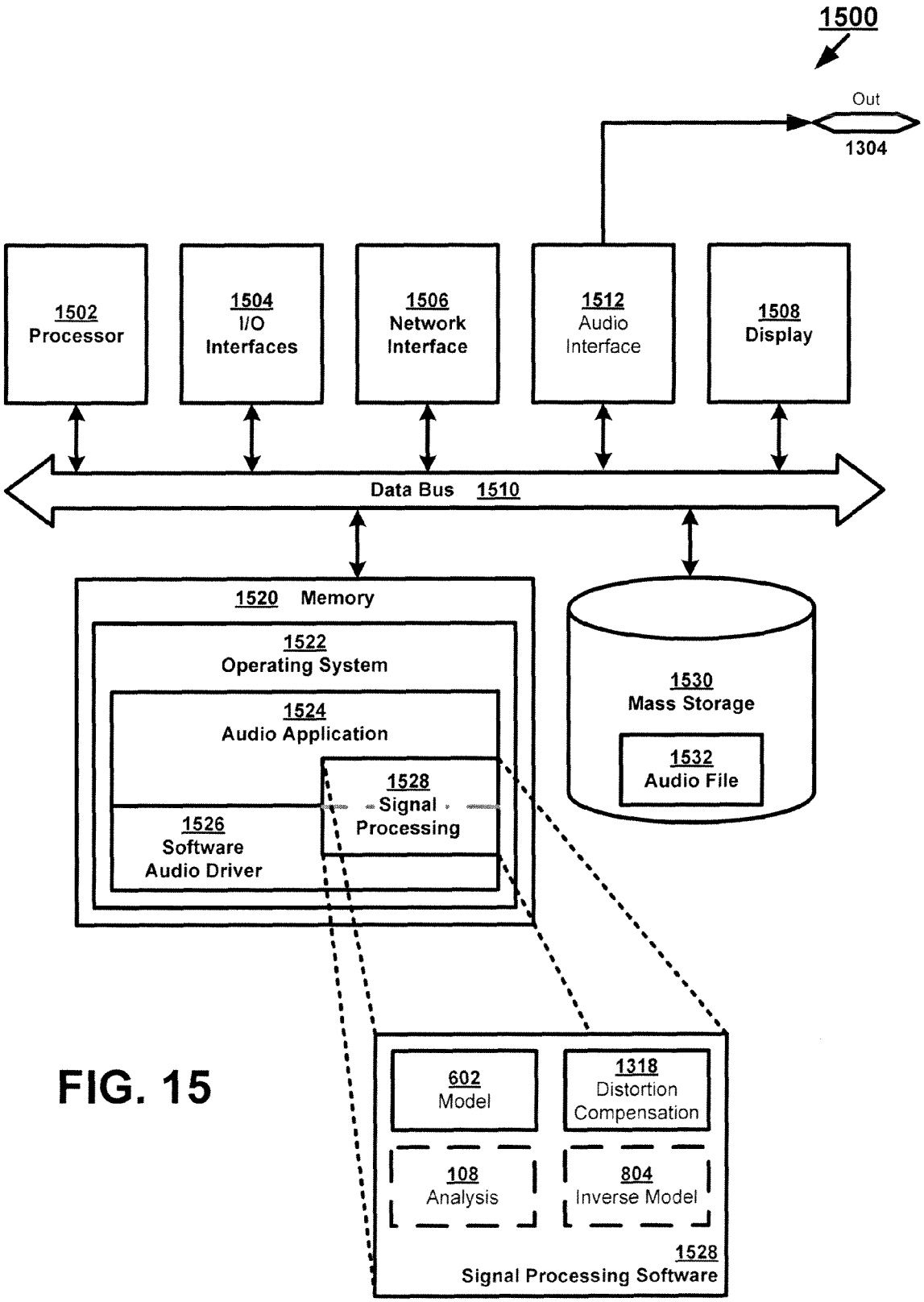
FIG. 15 illustrates an embodiment of a PC equipped with peak reduction audio enhancement.

In an embodiment where hardware audio drivers are not available for modification, the peak reduction can be implemented in software using a personal computer (PC) which is interfaced to a sound card or implemented as an "app" for a smart phone for the playback of sound. FIG. 15 illustrates an embodiment of a PC equipped with anti-distortion audio enhancement. Generally speaking, PC 1500 can comprise any one of a wide variety of computing devices, such as a desktop computer, portable computer, dedicated server computer, multiprocessor computing device, cellular telephone, PDA, handheld or pen based computer, embedded appliance and so forth. Regardless of its specific arrangement, PC 1500 can, for instance, comprise memory 1520, processor 1502, a number of input/output interfaces 1504, and mass storage 1530, audio interface 1512 for communicating a hardware audio driver through output 1304, wherein each of these devices is connected across one or more data buses 1510. Optionally, PC 1500 can also comprise a network interface device 1506 and display 1508, also connected across one or more data buses 1510.

Processing device 1502 can include a CPU, an auxiliary processor associated with the audio system, a semiconductor based microprocessor (in the form of a microchip), a macroprocessor, one or more ASICs, digital logic gates, a DSP or other hardware for executing instructions.

Input/output interfaces 1504 provide interfaces for the input and output of data. For example, these components can interface with a user input device (not shown), which may be a keyboard or a mouse. In other examples, especially a handheld device (e.g., PDA, mobile telephone), these components may interface with function keys or buttons, a touch sensitive screen, a stylus, etc. Display 1508 can comprise a computer monitor or a plasma screen for a PC or a liquid crystal display (LCD) on a hand held device, for example.

Network interface device 1506 comprises various components used to transmit and/or receive data over a network environment. By way of example, these may include a device that can communicate with both inputs and outputs, for instance, a modulator/demodulator (e.g., a modem), wireless (e.g., radio frequency (RF)) transceiver, a telephonic interface, a bridge, a router, network card, etc.

Memory 1520 can include any one of a combination of volatile memory elements and nonvolatile memory elements. Mass storage 1530 can also include nonvolatile memory elements (e.g., flash, hard drive, tape, rewritable compact disc (CD-RW), etc.). Memory 1520 comprises software which may include one or more separate programs, each of which includes an ordered listing of executable instructions for implementing logical functions. Often, the executable code can be loaded from nonvolatile memory elements including from components of memory 1520 and mass storage 1530. Specifically, the software can include native operating system 1522, one or more native applications, emulation systems, or emulated applications for any of a variety of operating systems and/or emulated hardware platforms, emulated operating systems, etc. These applications may further include audio application 1524, which may be either a stand-alone application or a plug-in, and audio driver 1526, which is used by applications to communicate with a hardware audio driver. Audio driver 1526 can further comprise signal processing software 1528 which comprises displacement model 602, distortion compensation module 1318, which can be any of those described previously, and optionally analysis module 108 and model inverse 804. Alternatively, audio application 1524 comprises signal processing software 1528. It should be noted, however, that the logic for performing these processes can also be implemented in hardware or a combination of software and hardware.

Mass storage 1530 can be formatted into one of a number of file systems which divide the storage medium into files. These files can include audio files 1532 which can hold sound samples such as songs that can be played back. The sound files can be stored in a wide variety of file formats including but not limited to RIFF, AIFF, WAV, MP3 and MP4.

Figure 16:
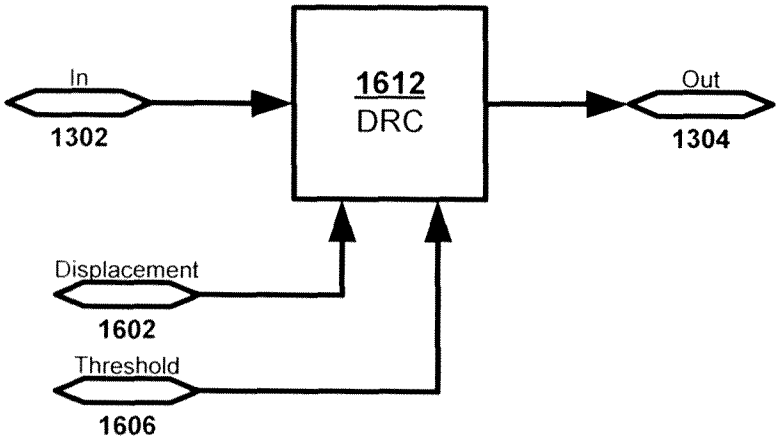
FIG. 16 shows an embodiment of a distortion compensation module employing time-domain dynamic range compression.

FIG. 16 shows an embodiment of a distortion compensation module employing time-domain dynamic range compression. Dynamic range compressor 1612 receives input signal 1302 and generates output signal 1304 on the basis of input signal 1302, displacement 1602 as predicted by the displacement model and threshold 1606. Dynamic range compressor 1612 applies a given input/output function to input signal 1302 to generate output signal 1304. The input/output function is selected based on threshold 1606.

Figure 17:
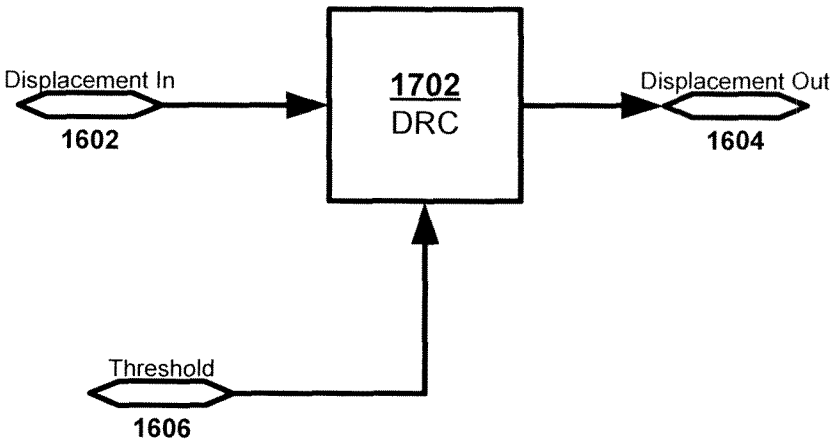
FIG. 17 shows an alternate embodiment of a distortion compensation module employing time-domain dynamic range compression applied to the displacement signal.

FIG. 17 shows an alternate embodiment of a distortion compensation module employing time-domain dynamic range compression applied to the displacement signal. The distortion compensation module is intended to be used in an implementation similar to audio driver 800. Dynamic range compressor 1702 receives displacement input signal 1602 and generates displacement output signal 1604 by applying a given input/output function. The input/output function is selected based on threshold 1606.

Figure 18:
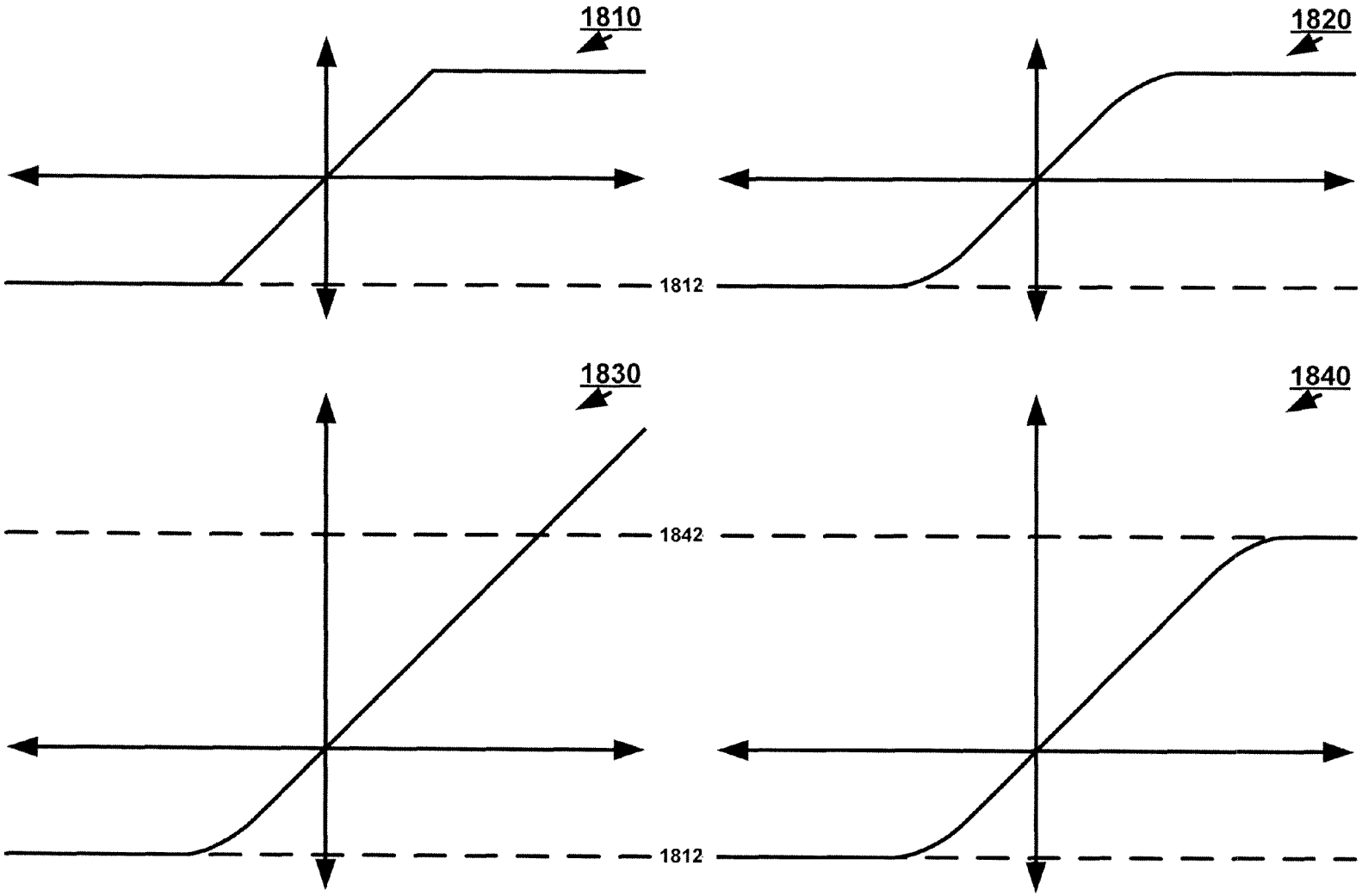
FIG. 18 illustrates four exemplary input/output functions which can be employed in a dynamic range compressor.

FIG. 18 illustrates four exemplary input/output functions which can be applied to input signal 1302 or displacement input signal 1602. Graph 1810 implements a clipping function, that is, dynamic range compressor 1612 or 1702 maps the input value to the output value until the input value has an absolute value greater than predetermined value 1812, after which predetermined value 1812 is used as an output instead. This predetermined value is based on the threshold, but is not necessarily the same as the threshold, for example using DRC 1612 the threshold is given in terms of the inward displacement and the input signal is given in terms of the voltage.

Clipping generates similar spectral artifacts to the rub and buzz distortion which is being avoided. Graph 1820 shows an input/output function which yields the same sort of clipping function but with a smooth transition from the linear region to the cutoff region. It should be noted that rub and buzz distortion occurs when inward displacement of the loudspeaker cone hits the base of the loudspeaker, so there is no need to compress the dynamic range in both polarities. Graph 1830 shows an input/output function with a one sided smooth clipping function. Note that negative voltage translates to inward displacement. Although rub and buzz distortion occurs on inward displacement, there is a limit to outward displacement as well before distortion takes place. As a result, a second limit can be placed on the outward displacement as shown by predetermined limit 1842 in graph 1840. Though graph 1840 shows an input/output function which applies smooth clipping in the positive and negative voltage directions, it is not necessarily symmetric.

Figure 19:
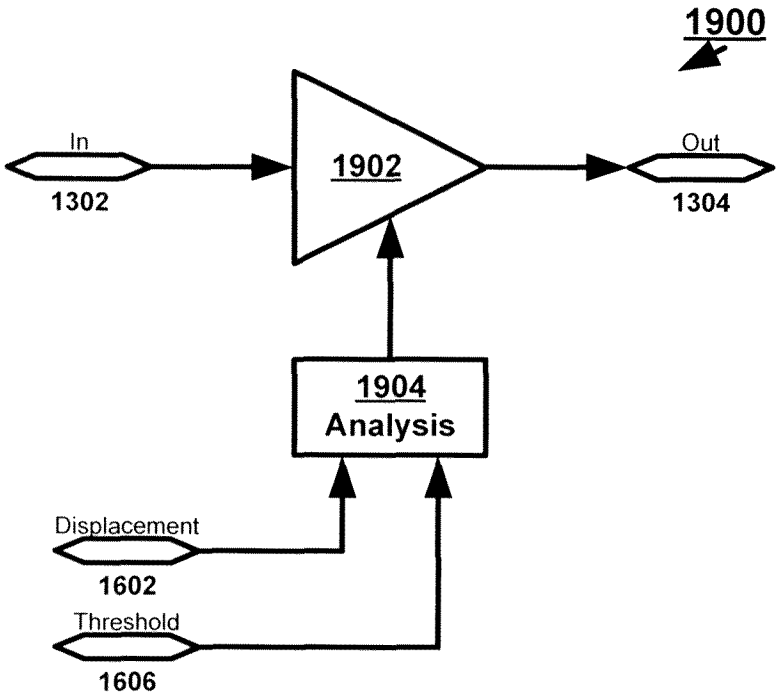
FIG. 19 shows an embodiment of a distortion compensation module employing automatic gain control.

FIG. 19 shows an embodiment of a distortion compensation module employing automatic gain control. Distortion compensation module 1900 comprises variable gain amplifier 1902 and analysis module 1904. Analysis module 1904 receives displacement value 1602 and threshold 1606 to determine the gain to be applied to input signal 1302 in order to generate output signal 1304. Attenuation is applied to the input signal when inward displacement value 1602 exceeds threshold 1606. With proper attenuation, the distortion is avoided. Abrupt attenuation can cause undesirable audible artifacts, so the attenuation can be provided with an attack time and a release time. Attenuation with attack time gradually increases attenuation until it reaches full attenuation after the period defined by the attack time. The attenuation then decreases until there is no attenuation after the period defined by the release time. Furthermore, attenuation can be applied when inward displacement value 1602 approaches threshold 1606, so that attenuation has already begun prior to the distortion occurring.

Figure 20:
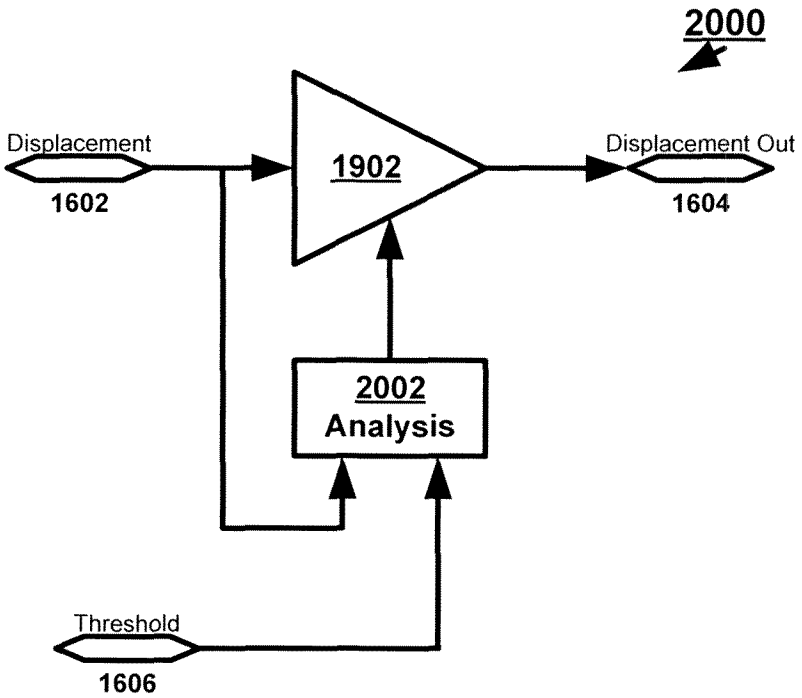
FIG. 20 shows another embodiment of a distortion compensation module employing automatic gain control.

FIG. 20 shows another embodiment of a distortion compensation module employing automatic gain control. Distortion compensation module 2000 comprises variable gain amplifier 1902 and analysis module 2002. Analysis module 2002 receives displacement input signal 1602 and threshold 1606 and determines the gain to be applied to displacement input signal 1602 in order to generate displacement output signal 1604. Attenuation is applied to the displacement input signal when it exceeds threshold 1606. An attack time and release time can be used to mitigate undesirable audible artifacts.

The gain profile implemented by distortion compensation module 1900 and 2000 can be an adaptive system. In particular, analysis engines 1902 and 2002 can be implemented to adaptively find an optimal solution. The object of the optimization problem is to adaptively determine the attenuation curve C(f) within the region in which rub and buzz is applicable. The attenuation curve sought should minimize the loss in loudness, ΔL given by equation (1).

$$\Delta L=\int Kf^2A(f)H_x(f)V(f)\{1-C(f)\}df \quad (1)$$

$$\Delta x=H_x(f)V(f)\{1-C(f)\} \quad (2)$$

In equation (1), the frequency response of the displacement model is given by $H_x(f)$. The loudness weighing curve A(f) represents the sensitivity of the human ear, the input voltage signal (V(f)) is the signal driving the loudspeaker, and the value of the constant K depends on the area of loudspeaker, density of air and the distance of the listener. While the cost function can be defined in terms of ΔL, the adaptive system has a constraint imposed that the change in displacement Δx cannot cause the displacement x to exceed the predetermined threshold.

Figure 21:
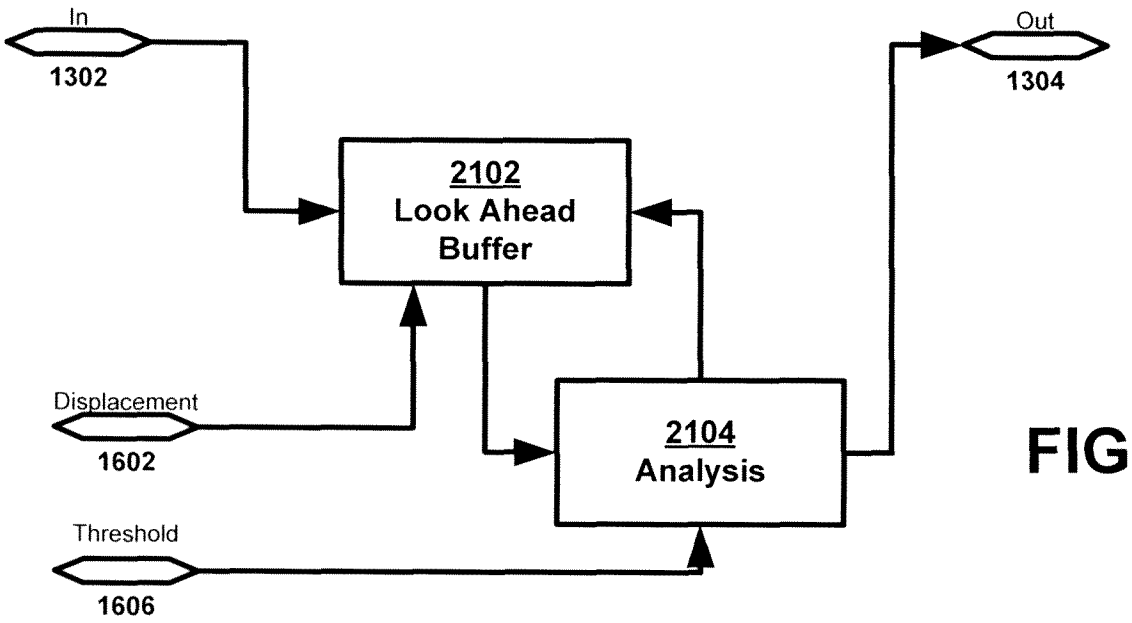
FIG. 21 illustrates an embodiment of a distortion compensation module with a look ahead peak reducer.

FIG. 21 illustrates an embodiment of a distortion compensation module with a look ahead peak reducer. It comprises look ahead buffer 2102 and analysis engine 2104. Look ahead buffer stores a number of samples from input 1302. W+1 samples are stored in look ahead buffer. Analysis engine 2104 receives one or more threshold values 1606. Analysis engine 2104 ensures the output values sent to output 1304 do not exceed the threshold value.

Figure 22:
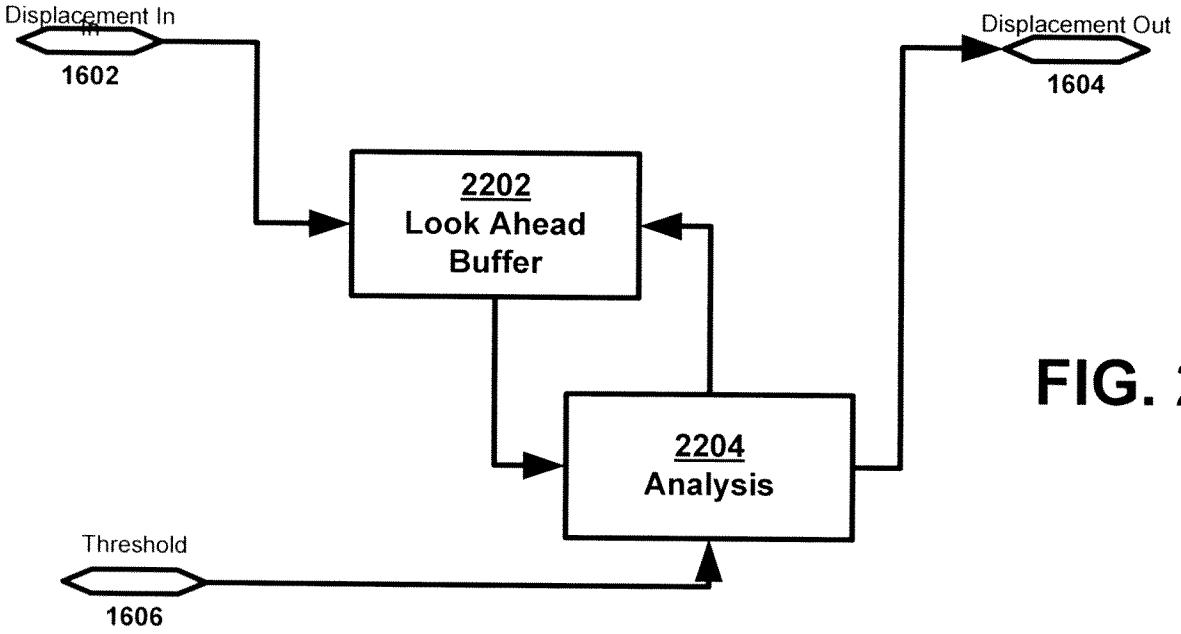
FIG. 22 illustrates another embodiment of a distortion compensation module with a look ahead peak reducer.

FIG. 22 illustrates another embodiment of a distortion compensation module with a look ahead peak reducer. It comprises look ahead buffer 2202 and analysis engine 2204. Look ahead buffer stores a number of samples from displacement input 1602. W+1 samples are stored in look ahead buffer. Analysis engine 2204 receives one or more threshold values 1606. Analysis engine 2204 ensures the output values sent to output displacement 1604 do not exceed the threshold value.

Figure 23:
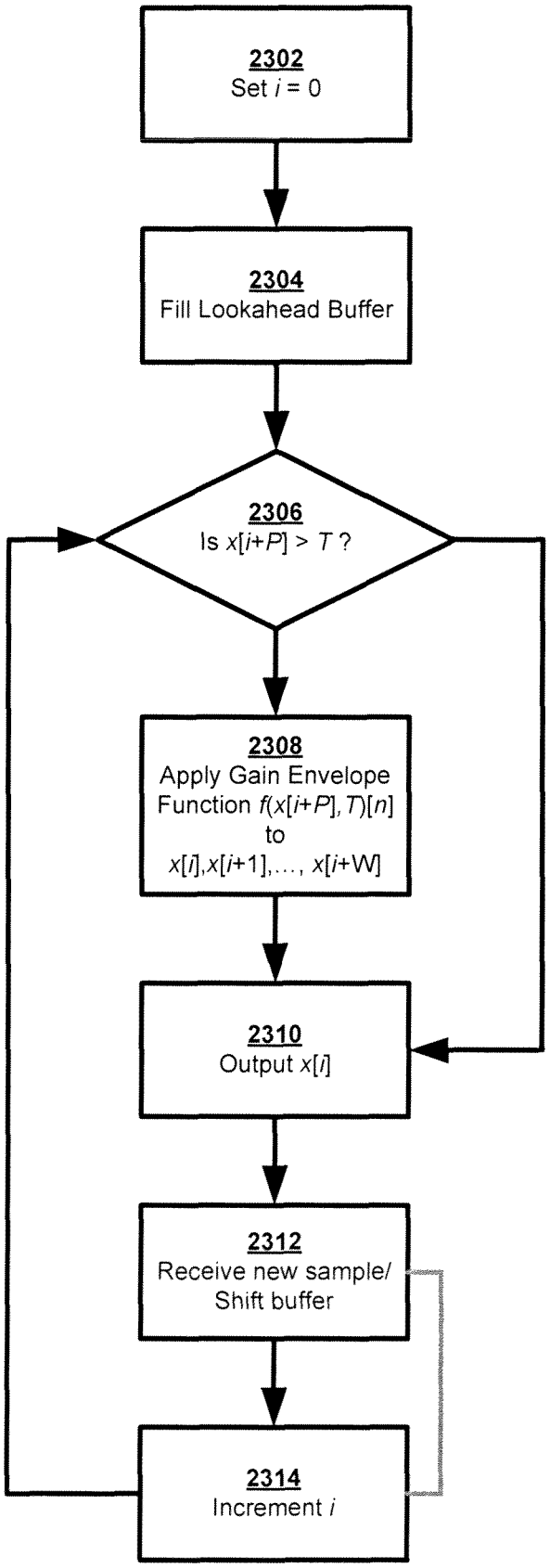
FIG. 23 is a flowchart illustrating an exemplary embodiment of a method employed by analysis engine 2104 or 2204 to insure the output values remain below a given threshold.

FIG. 23 is a flowchart illustrating an exemplary embodiment of a method employed by analysis engine 2104 or 2204 to ensure that output values remain below a given threshold. At step 2302 an index variable denoted by i is initialized to zero. At step 2304, look ahead buffer 2102 or 2202 is filled with W+1 input samples. At step 2306, a comparison is made of input sample x[i+P] to threshold T. If x[i+P]>T, then at step 2308, a gain envelope function $f$(x[i+P],T)[n] is applied to all samples in the look ahead buffer, that is x[i], x[i+1], . . . , x[i+W]. Specifically, each sample x[i+j] is replaced by x[i+j]×$f$(x[i+P],T)[j] in look ahead buffer 2102 or 2202. At step 2310, x[i] is sent to the output. At step 2312, the sample x[i] is removed from the look ahead buffer and sample x[i+W+1] is added to the look ahead buffer, so that the look ahead buffer holds x[i+1], x[i+2], . . . , x[i+W], x[t+W+1]. At step 2314, the index variable is incremented. The process can then repeat at step 2306.

At step 2306, it was assumed that the threshold T was an upper limit. However, equivalently, the method can be applied to a lower limit as well. In that case, step 2306 would determine whether x[i+P]<T. The look ahead index P is a predetermined number between 0 and W. In one embodiment P is chosen at the midpoint between 0 and W. Analysis engine 2104 or 2204 looks ahead by P samples to determine how much to attenuate the signal if at all. As a net result, there is a delay of W samples, so the choice of W should be small enough so that the delay is not significantly perceivable.

Figure 24:
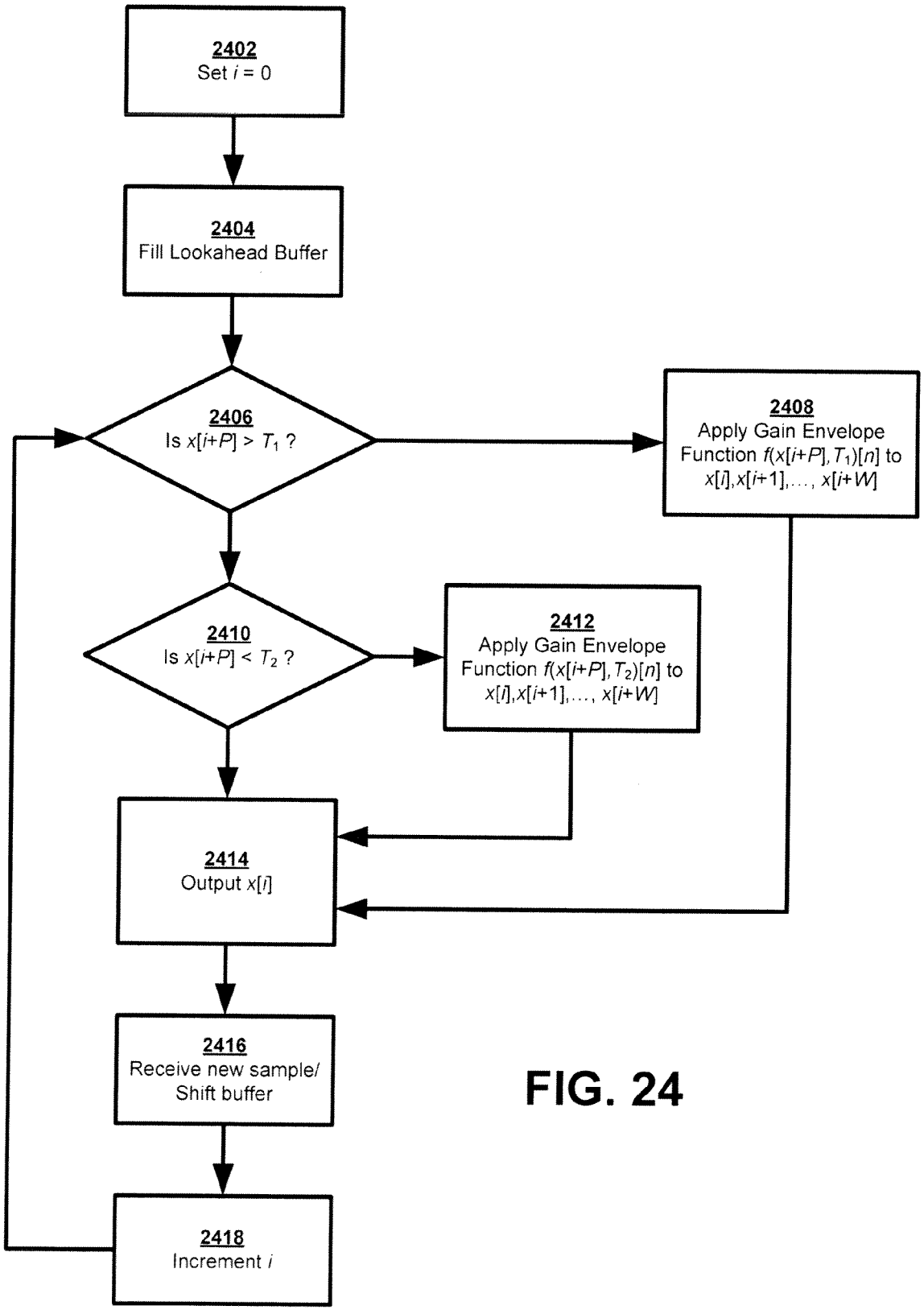
FIG. 24 is a flowchart illustrating an exemplary embodiment of the method employed by another embodiment of an analysis engine.

FIG. 24 is a flowchart illustrating an exemplary embodiment of a method employed by another embodiment of analysis engine 2104 or 2204 which receives an upper limit threshold $T_1$ and a lower limit threshold $T_2$. At step 2402, an index variable denoted by i is initialized to zero. At step 2404, look ahead buffer 2102 or 2202 is filled with W+1 input samples. At step 2406, a comparison is made of input sample x[i+P] and upper threshold, $T_1$. If x[i+P]>$T_1$, then at step 2408, a gain envelope function $f$(x[i+W],$T_1$)[n] is applied to all samples in the look ahead buffer, that is x[i], x[i+1], . . . , x[i+W]. Otherwise at step 2410, a comparison is made of input sample x[i+P] to lower threshold, $T_2$. If x[i+P]<$T_2$, then at step 2412, a gain envelope function $f$(x[i+W],$T_2$)[n] is applied to all samples in the look ahead buffer, that is x[i], x[i+1], . . . , x[i+W]. At step 2414, x[i] is sent to the output. At step 2416, the sample z[i] is removed from the look ahead buffer and sample x[i+W+1] is added to the look ahead buffer so the look ahead buffer now holds x[i+1], x[i+2], . . . , x[i+W], x[i+W+1]. At step 418, the index variable i is incremented. The process can then repeat at step 2406.

In the special case where $T_1=-T_2$, steps 2406 and 2410 can be combined into a single test where |x[i+P]| is compared to $T_1$. If |x[i+P]|>$T_1$, then the appropriate gain envelope function can be applied to all samples in the look ahead buffer.

Figure 25:
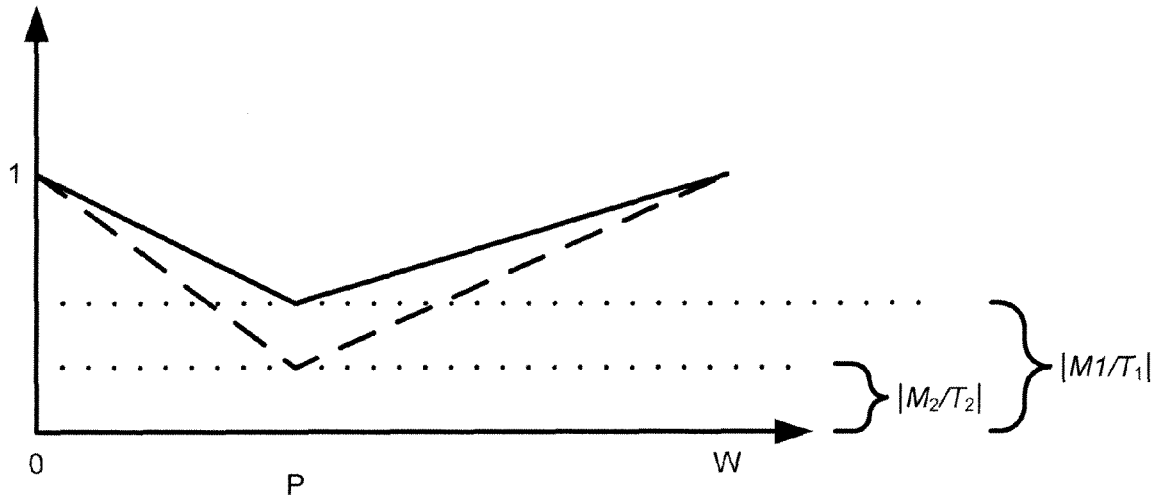
FIG. 25 illustrates desirable characteristics in a gain envelope function.
Figure 26:
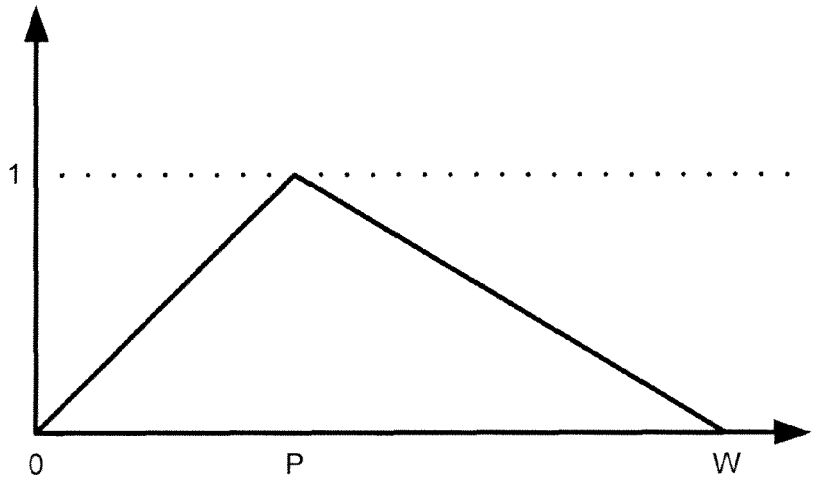
FIG. 26 shows an example of a basis function for generating a family of gain envelope functions.

At step 2308, 2408 and 2412, f denotes a parameterized family of functions. For different values of M and T, f yields a different gain envelope function which is a function of n. As illustrated in FIG. 25, the desired characteristics of this family of functions is $f$(M,T)[0]=1, $f$(M,T)[W]=1, and $$f(M,T)[P]=\left|\frac{T}{M}\right|.$$

Another desirable characteristic of functions in the family of functions is that they are monotonic between 0 and P and between P and W. For example, the functions shown in FIG. 25 monotonically decrease between 0 and P and increase monotonically between P and W. FIG. 8 shows two examples of gain envelope functions for different values of M and T.

One method to construct a family of functions is to build a family of gain envelope functions from a basis function. The characteristics of a basis function g are that g[0]=0 g[P]=1, and g[W]=0. It is also desirable though not required that g be monotonically increasing between 0 and P and monotonically decreasing between P and W. An example is shown in FIG.

26, which is a piecewise linear basis function. The family of gain envelope functions is derived by the equation (3).

$$f(M, T)[n] = 1 - \left(1 - \left|\frac{T}{M}\right|\right)g[n] \tag{3}$$

Because g[0]=0, then f(M,T)[0]=1; because g[P]=1 then $$f\ f(M, T)[P] = \left|\frac{T}{M}\right|$$

and because g[W]=0, then g(M,T)[W]=1, meeting the desired characteristics for the family of gain envelope functions. Furthermore, if g is monotonic between 0 and P and between P and W, then f(M,T) is monotonic between 0 and P and between P and W. It should be emphasized that though a basis function is a convenient and efficient way to generate a family of gain envelope functions, it is by no means the only way nor does it is cover all suitable families of gain envelope functions.

Figure 27A:
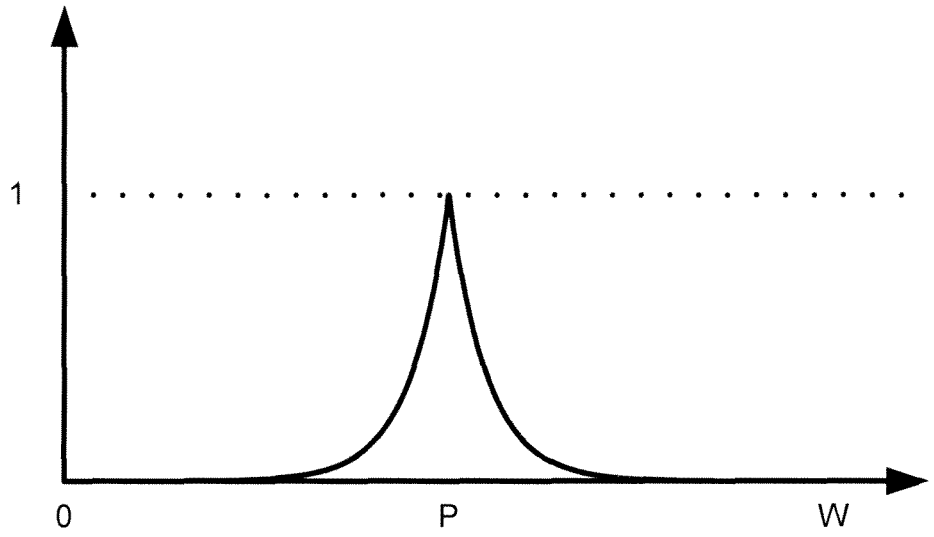
FIGS. 27A-D show other examples of basis functions which can be used to generate a family of gain envelope functions.
Figure 27B:
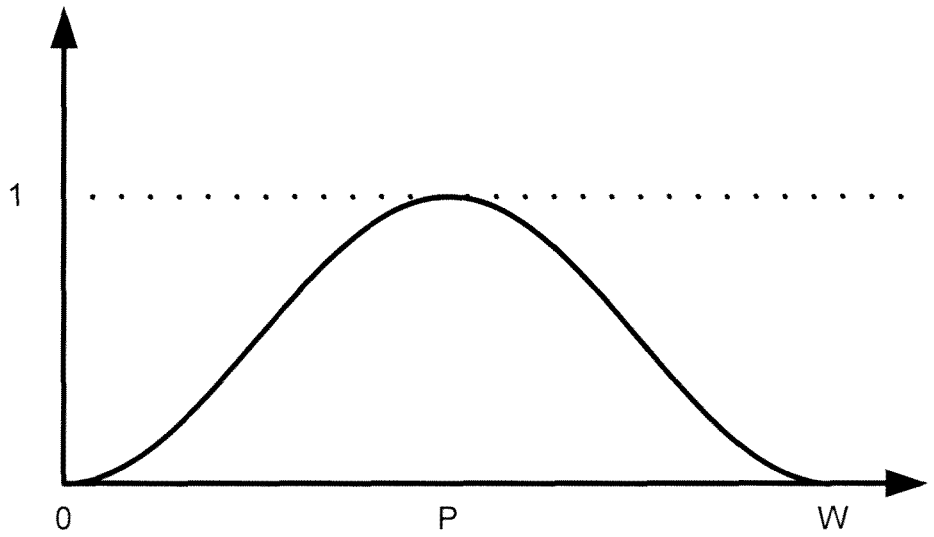
Figure 27C:
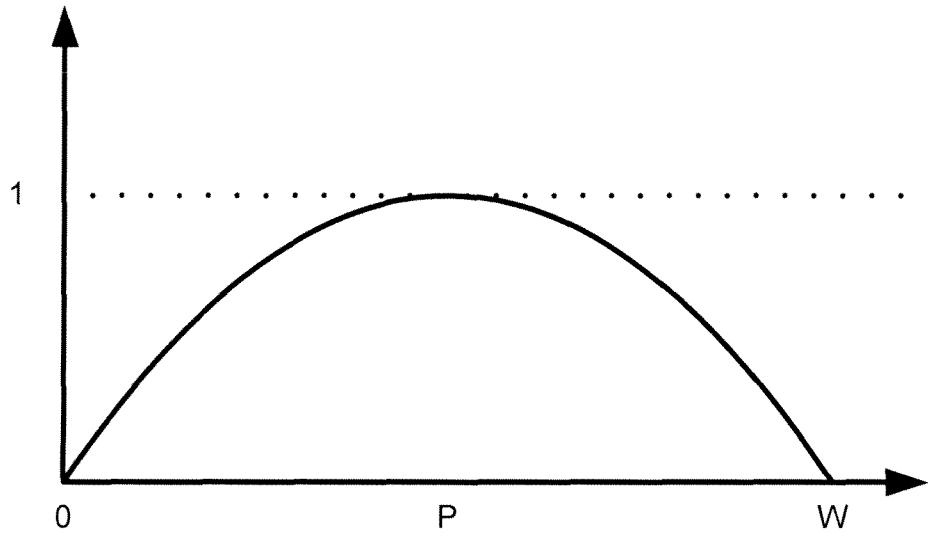
Figure 27D:
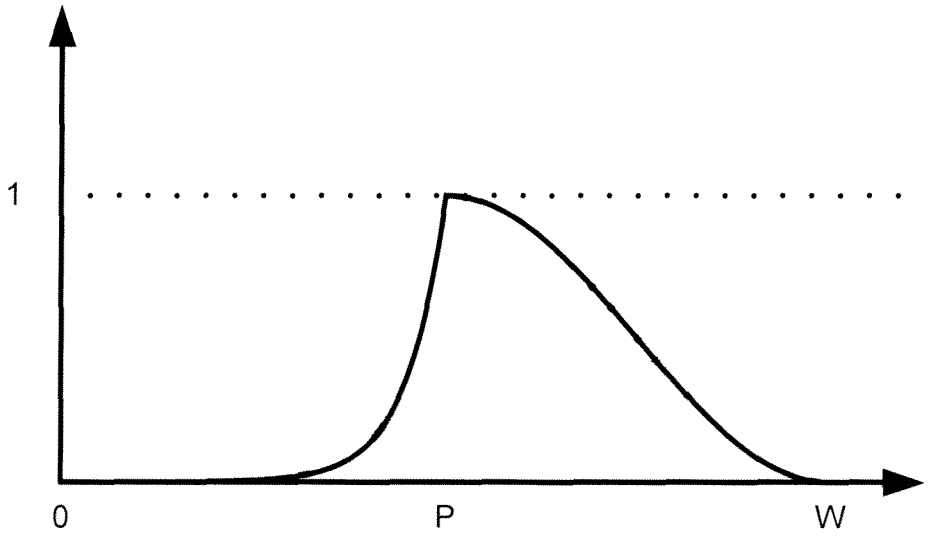

FIGS. 27A-D show other examples of basis functions which can be used to generate a family of gain envelope functions. FIG. 27A is a piecewise linear basis function in dBs that is viewed on a logarithmic scale. FIG. 27B is an example of a window function used as a basis function. FIG. 27C is an example of using a Hamming window function as a basis function. Finally, FIG. 27D is an example of a basis function which does not have any symmetry between its increasing portion and its decreasing portion.

Another variant of the parameterized family of gain functions is to use more than one sample in the look ahead buffer to define the gain function. More specifically, the gain applied to all samples in the look ahead buffer is a function f(x[i], x[i+1], . . . , x[i+W], T). An example of such a gain envelope function is given by equation (2).

$$f(x[i], x[i+1], \ldots, x[i+W], T)[n] = 1 - \left(1 - \left|\frac{T}{M}\right|\right)g[n]. \tag{4}$$

where $$M = \sqrt{\sum_{k=0}^{W} x^2[i+k]} \text{ or } M = \sum_{k=0}^{W} |x[i+k]|$$

In this example, the gain function can be used to control the power of a signal.

Figure 28:
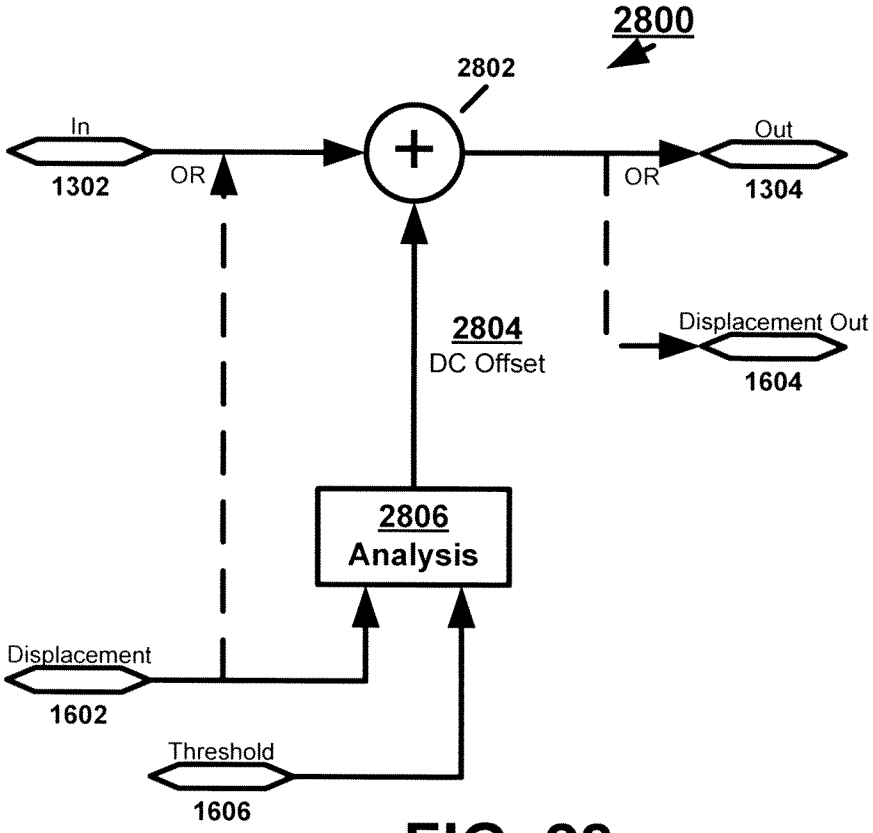
FIG. 28 shows an embodiment of a distortion compensation module applying a direct current (DC) offset.

FIG. 28 shows an embodiment of a distortion compensation module applying a constant (DC) offset. Distortion compensation module 2800 includes analysis module 2806 which computes DC offset 2804 based on displacement value 1602 and threshold value 1208. DC offset 2804 is added to input signal 1302 by adder 2802 to produce output signal 1304. Alternatively, distortion compensation module 2800 adds a DC offset to displacement input 1602 to produced displacement output signal 1604. Generally, prolonged DC offsets are to be avoided in loudspeakers as they may have detrimental effects. However, since rub and buzz distortion occurs due to excessive inward displacement, the addition of a positive DC offset can be used to displace the loudspeaker cone outward by a small amount, negating some of the inward displacement. Sufficient DC offset can be added as determined by analysis module 2806 when needed. Often, because of potential loudspeaker damage, many audio drivers are equipped with filters to suppress any DC component. As a result, a very low frequency signal can be used in place of a DC offset. This frequency can be sufficiently low as to not significantly affect the listening experience.

Figure 29:
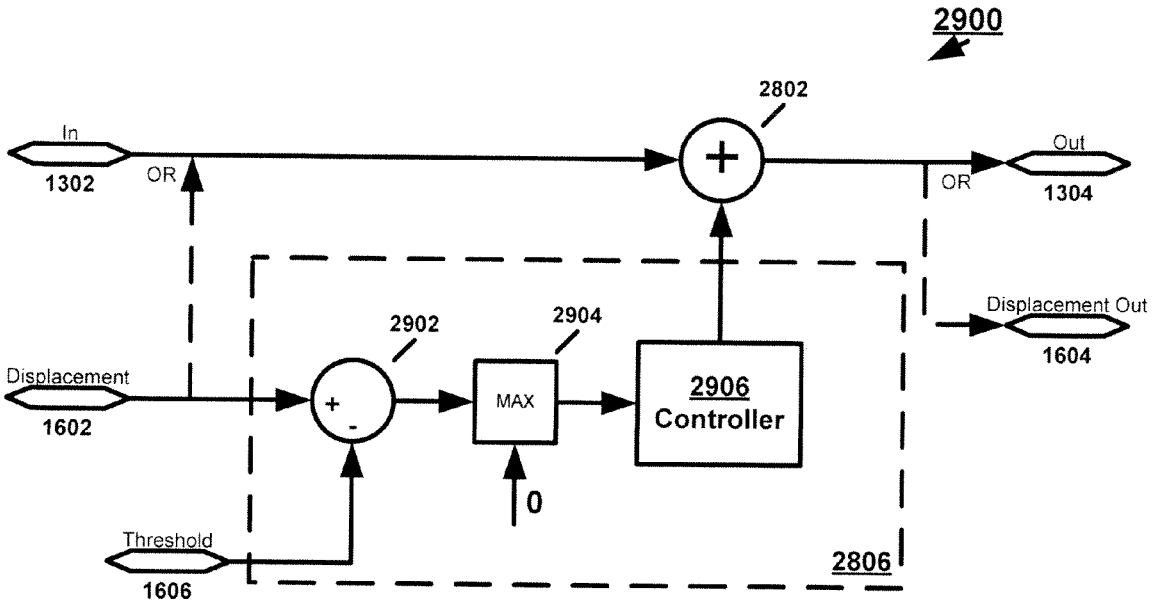
FIG. 29 shows another embodiment of a distortion compensation module applying a DC offset.

FIG. 29 shows another embodiment of a distortion compensation module applying a DC offset. Like distortion compensation module 2800, distortion compensation module comprises analysis module 2806 which determines DC offset 2804 which is added by adder 2802. Distortion compensation module 2900 can apply DC offset 2804 to displacement 1604 to produce displacement output 1606, can apply DC offset 2804 to input signal 1302 to produce displacement output signal 1304, or can perform other suitable functions. More specifically, analysis module 2806 comprises comparator 2902, maximum function 2904 and controller 2906. Comparator 2902 calculates the difference between displacement value 1602 and threshold 1606. Maximum function 2904 takes the maximum between the difference and zero, as a result controller 2906 receives an error function which is zero when the displacement value is less than the threshold and is the difference when the threshold is less than the displacement value. Controller 2906 can be a proportional-integral-derivative (PID) controller.

PID controllers are well known in the art for providing a feedback mechanism to adjust a process variable, which in this case is the error signal described above, to a particular set point, which in this case is zero. The proportional coefficient, P, integral coefficient, I, and derivative coefficient D are used to adjust the PID controller in response to the current error, accumulated past error and predicted future error, respectively.

As an example, the output of cone displacement model 602 is denoted as y[n] and the error is expressed as e[n]=max(y[n]−s,0), where s is the displacement at which distortion takes place. The output of PID controller u[n] can be expressed by the following equation:

$$u[n] = u[n-1] + \underbrace{P(e[n] - e[n-1])}_{Proportional} + \underbrace{I(e[n])}_{Integral} + \underbrace{D(e[n] - 2e[n-1] + e[n-2])}_{Derivative}$$

or in by the alternate formula:

$$u[n]=A(u[n-1]+P(e[n]-e[n-1])+I(e[n])+D(e[n]-2e[n-1]+e[n-2]))$$

where A is a scaling factor such as 0.999. In another embodiment, the control signal u[n] can be filtered to smooth out the signal.

As denoted above, the P coefficient, I coefficient, and the D coefficient control how fast the system responds to the current, accumulated past, and predicted future error respectively. The choice of these coefficients control the attack, release and settling time of the controller. Furthermore, the coefficients define the frequency range of the control signal, and the PID controller is tuned to generate a correction signal that comprises frequencies defined by the rub-and-buzz region of the loudspeaker. Other adaptation or optimization algorithms can be used to tune the PID controller.

Based on the error signal and the P, I, and D coefficients, the PID controller generates a control signal which is added to the audio signal. The control signal is adjusted by the PID controller to drive the error signal received to zero.

Figure 30:
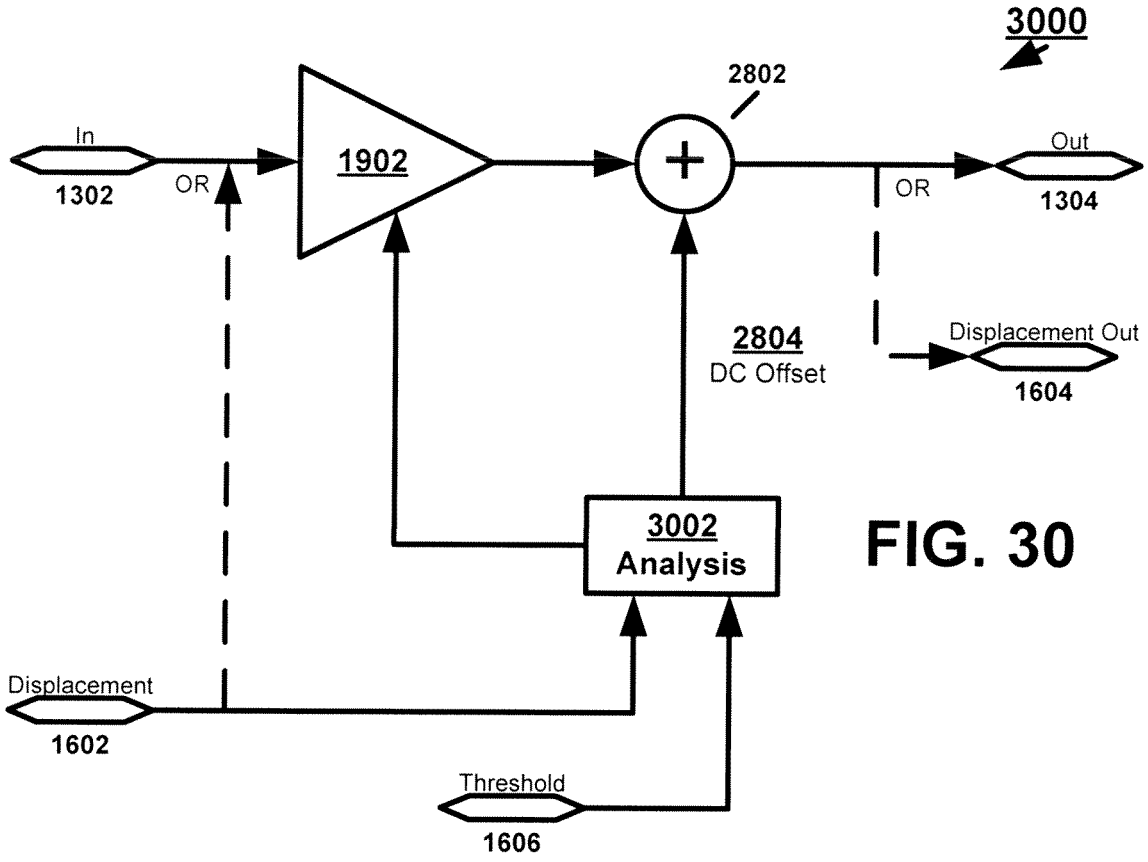
FIG. 30 shows an embodiment of a distortion compensation module applying a DC offset and automatic gain control.

FIG. 30 shows an embodiment of a distortion compensation module applying a DC offset and automatic gain control. Distortion compensation module 3000 comprise analysis module 3002, which adjusts the gain on variable gain amplifier 1902 and derives DC offset 2804 which is added as shown by adder 2802. This hybrid architecture employs the advantages of both the automatic gain control approach and the DC offset approach. Distortion compensation module 3000 can be applied to input signal 1302 or displacement signal 1602.

Figure 31:
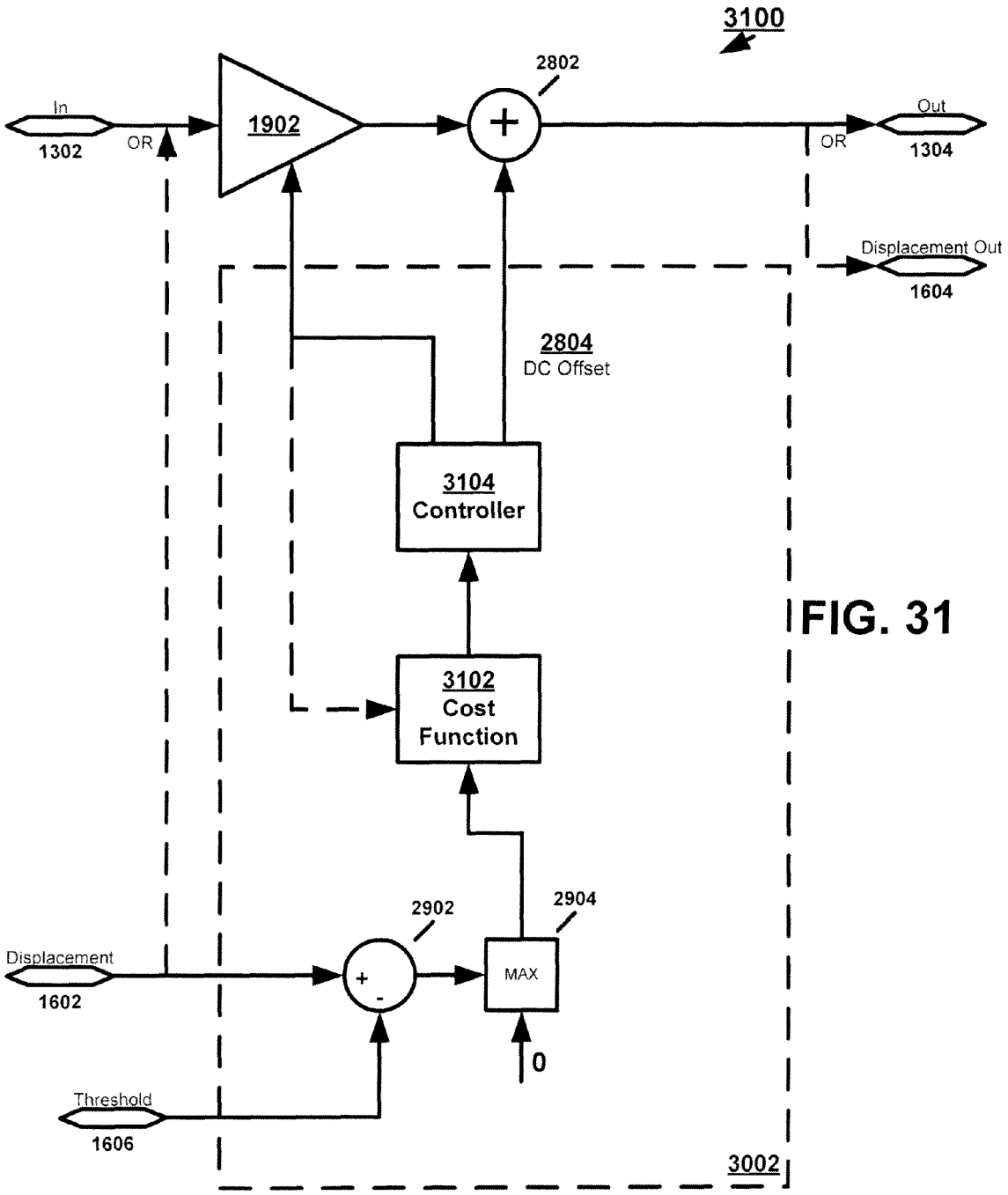
FIG. 31 shows a specific implementation of a distortion compensation module applying a DC offset and automatic gain control.

FIG. 31 shows a specific implementation of distortion compensation module 3000. Analysis module 3002 comprises comparator 2902 and maximum function 2904 which generates an error signal as described above for distortion compensation module 2900. The error signal is used to generate a cost function 3102. The cost function can also include the gain applied to variable gain amplifier 1902. Based on the cost function, controller 3104 sets the gain on variable gain amplifier 1902 and derives DC offset 2804. The gain can be incorporated into the cost function to encourage or discourage the use of automatic gain adjustment by controller 3104. Controller 3104 can be a PID controller similar to that described for distortion compensation module 2900.

Figure 32:
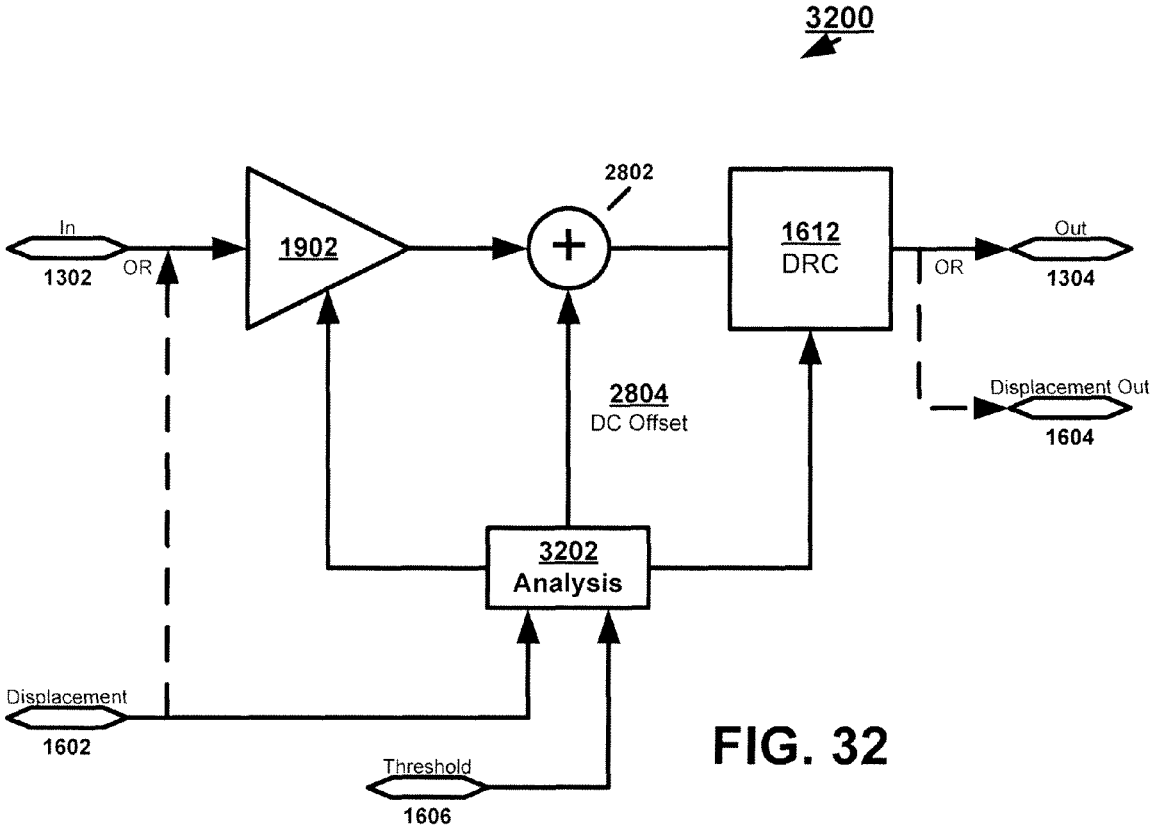
FIG. 32 shows an embodiment of a distortion compensation module applying a DC offset, automatic gain control and time-domain dynamic range compression.

FIG. 32 shows an embodiment of a distortion compensation module applying a DC offset, automatic gain control and time-domain dynamic range compression. Analysis module 3202 receives displacement value 1602 and threshold 1606 sets the gain on variable gain amplifier 1902, derives DC offset 2804 and sets the dynamic range compressor 1612.

It should be noted that distortion compensation module 3200 can be applied to input signal 1302 or displacement signal 1602 as can most of the remaining distortion compensation modules described below. In order to maintain clarity in the succeeding FIGURES, the FIGURES are depicted as only applying to input signal 1302. It should be understood that the distortion compensation modules can easily be adapted to apply to distortion input signal 1602.

Figure 33:
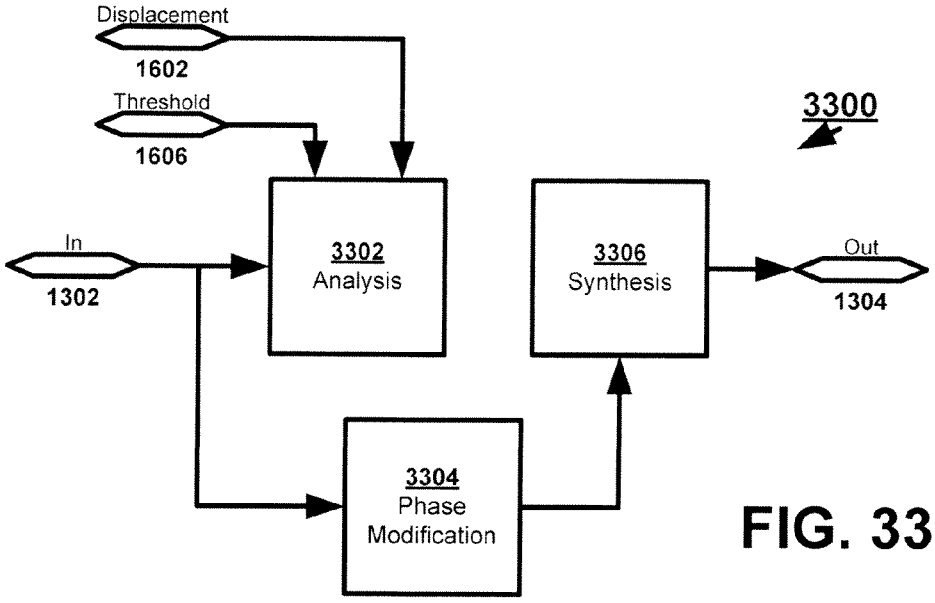
FIG. 33 shows an embodiment of a distortion compensation module employing phase manipulation which can be used in speech application such as a cellular telephone.

FIG. 33 shows an embodiment of a distortion compensation module employing phase manipulation which can be used in a speech-related application such as a cellular telephone. Distortion compensation module 3300 comprises analysis module 3302, phase modification module 3304, and synthesis module 3306. The speech based phase modification approach breaks down the audio signal into tracks. Human speech can be modeled as a plurality of tracks which have a frequency, an amplitude and phase associated with it. Analysis module 3302 subdivides a signal into frames and determines the frequency, amplitude and phase of each track over the frame. Phase modification module 3304 using the frequency, amplitude and phase information of each track determines and optimal phase for each track in order to minimize the peak amplitude. Across the frame, the frequency, amplitude and optimal phase are interpolated. These revised values are then used by synthesis module 3306 to construct a new audio signal which has a lower peak amplitude.

Specific systems and methods for using phase modification can be found in previously filed application Ser. No. 61/290,001, entitled "System and Method for Reducing Rub and Buzz Distortion in a Loudspeaker," filed on Dec. 23, 2009 and in U.S. Pat. No. 4,856,068 both of which are incorporated by reference.

Figure 34:
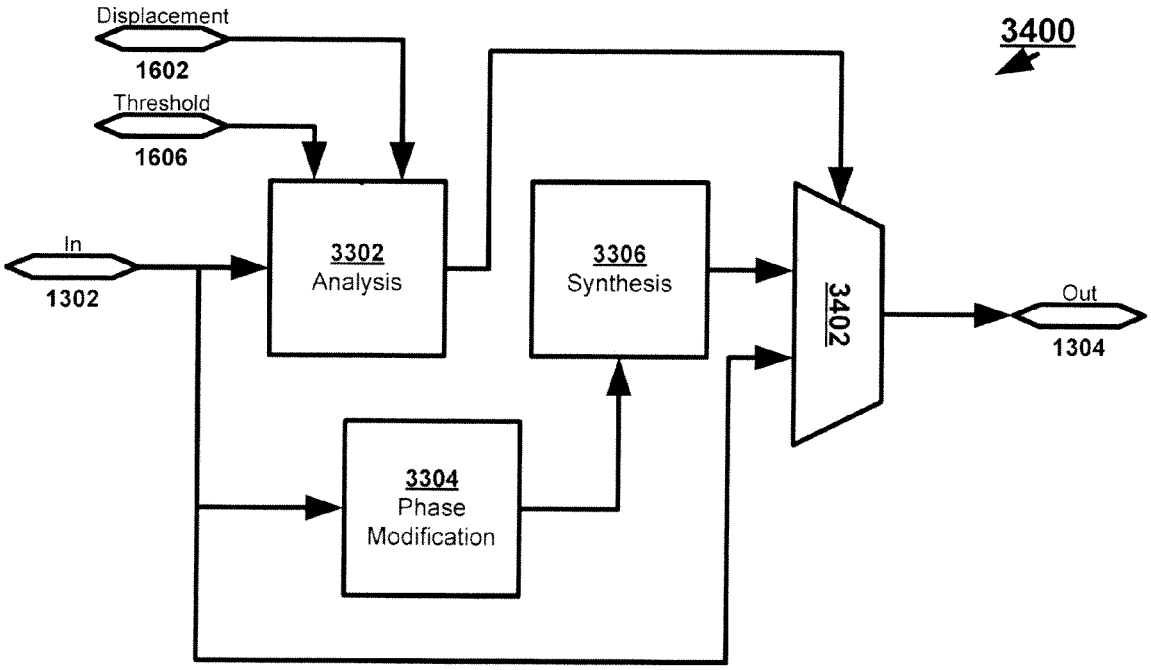
FIG. 34 shows another embodiment of a distortion compensation module employing phase manipulation.

FIG. 34 shows another embodiment of a distortion compensation module employing phase manipulation. Distortion compensation module 3400 is similar to distortion compensation module 3300 described above with analysis module 3302, phase modification module 3304, and synthesis module 3306. In addition, distortion compensation module 3400 further comprises multiplexer 3402 which can also be implemented as a switch or can be implemented in software by conditional code. If analysis module 3302 determines, such as based on displacement value 1602 and threshold 1606, that no distortion is imminent, the phase manipulation is bypassed and input signal 1302 is permitted to pass unaltered.

Figure 35:
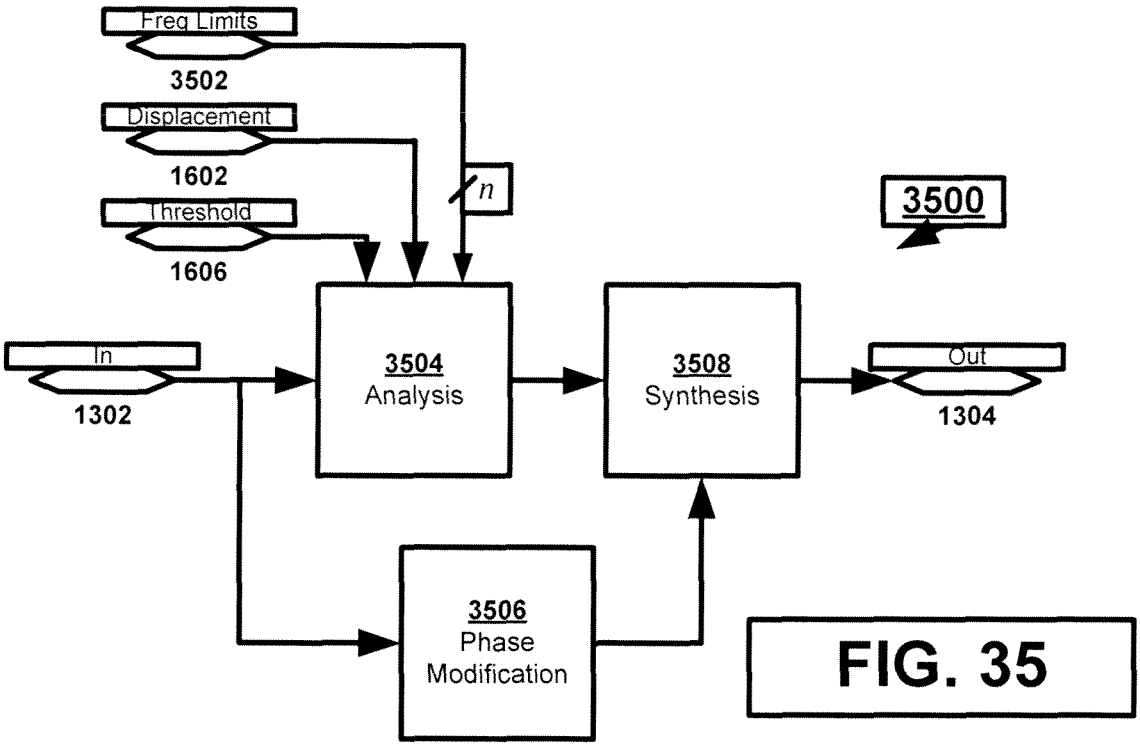
FIG. 35 shows yet another embodiment of a distortion compensation module employing phase manipulation.

FIG. 35 shows yet another embodiment of a distortion compensation module employing phase manipulation. Distortion compensation module 3500 comprises analysis module 3504, phase modification module 3506 and synthesis module 3508. Analysis module 3504 receives frequency limits 3502, which are the maximum amplitude of frequencies in the vulnerable range as determined during the measurement phase of the model building. For example, these values are determined at step 320. Analysis module 3504 determines, such as based on displacement value 1602 and threshold 1606, whether there would be any distortion present if uncompensated. If no distortion is present then input signal 1302 is permitted to pass unaltered. If distortion is predicted, the leading offending frequencies are selected, such as the frequencies that are closest to their frequency limits. Those frequencies are suppressed and tracks corresponding to those frequencies are determined along with the magnitude and phase of those tracks.

Phase modification module 3506 using the frequency, amplitude and phase information of each track determines and optimal phase for each track in order to minimize the peak amplitude. Across the frame, the frequency, amplitude and optimal phase are interpolated. These revised values are then used by synthesis module 3508 to construct a replacement signal for the suppressed frequencies but has a lower peak amplitude. This replacement signal is then recombined into the audio signal after the suppression of frequencies by synthesis module 3508.

The advantage of distortion compensation module 3500 over distortion compensation module 3300 is that only a few offending frequencies are altered rather than all frequencies as is the case with distortion compensation module 3300.

Figure 36:
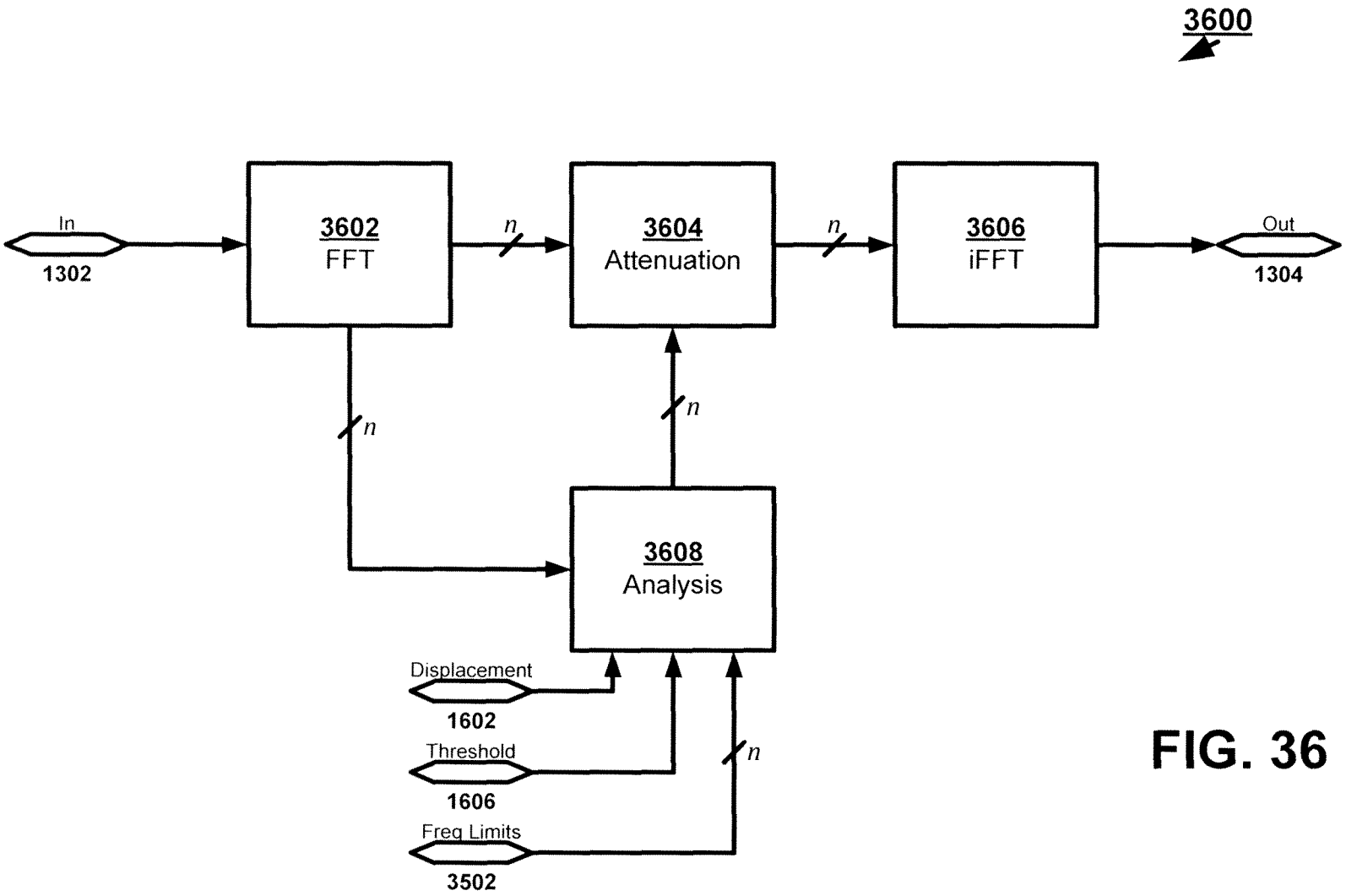
FIG. 36 shows an embodiment of a distortion compensation module operating in the frequency domain.

FIG. 36 shows an embodiment of a distortion compensation module operating in the frequency domain. Distortion compensation module 3600 comprises FFT 3602, attenuation bank 3604, inverse FFT (iFFT) 3606 and analysis module 3608. Analysis module 3608 receives frequency limits 3502 and frequency domain data generated by FFT 3602. Analysis module 3608 determines whether distortion would be present in an uncompensated signal based on displacement value 1602 and threshold 1606. If distortion would be present, based on the frequency domain data and frequency limits 3502, analysis module 3608 determines the worst offending frequencies that is, any frequency that is close to its corresponding frequency limit. The selected frequencies are communicated to attenuation bank 3604, which attenuates the selected frequencies. In a variation, the attenuation can have an attack and release time. In another variation, not only is the offending frequency or frequencies attenuated, but also nearby frequencies are attenuated as well.

Figure 37:
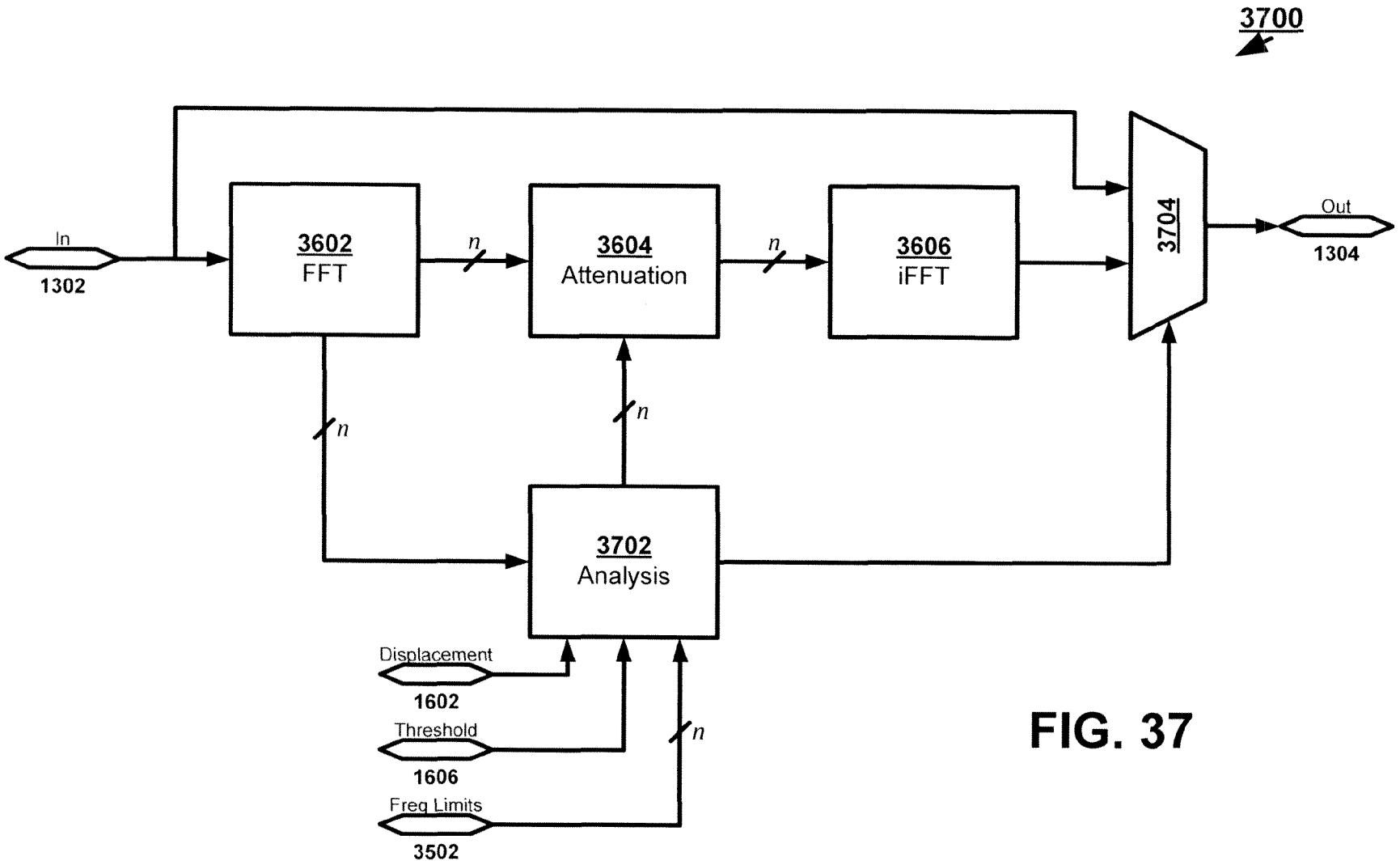
FIG. 37 shows another embodiment of a distortion compensation module operating in the frequency domain.

FIG. 37 shows another embodiment of a distortion compensation module operating in the frequency domain. Distortion compensation module 3700 comprises FFT 3602, attenuation bank 3604, iFFT 3606 and analysis module 3702. FFT 3602, attenuation band 3604 and iFFT 3606 is as described above. However, analysis module 3702 determines (such as based on displacement value 1602 and threshold 1606) whether distortion would occur in an uncompensated signal. If not, then multiplexer 3704 allows input signal 1302 to pass unaltered and the compensation logic can be bypassed completely.

Figure 38:
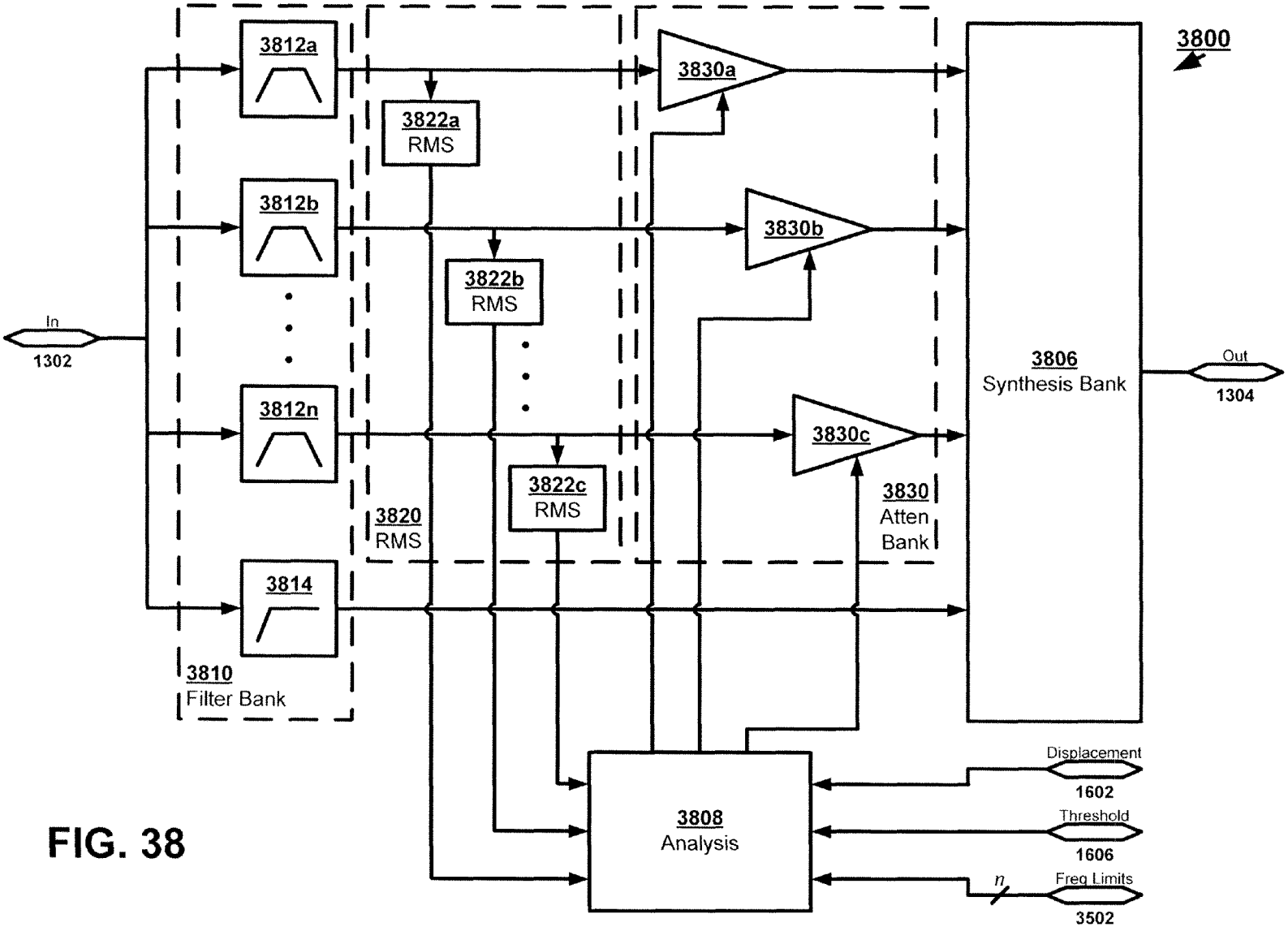
FIG. 38 shows an embodiment of a distortion compensation module employing a filter bank.

FIG. 38 shows an embodiment of a distortion compensation module employing a filter bank. Distortion compensation module 3800 comprises filter bank 3810, RMS bank 3820, attenuation bank 3830, synthesis bank 3806, and analysis module 3808. Filter bank 3810 separates input signal 1302 into a plurality of frequency bands within the vulnerable frequency range. In addition, it provides a remainder signal which comprises frequency components above the vulnerable frequency range. As shown in this example, filter bank 3810 comprises a plurality of band pass filters 3812*a* through 3812*n* and high pass filter 3814. High pass filter 3814 isolates frequencies above the vulnerable frequencies and each band pass filter isolates a frequency band within the vulnerable frequency range. RMS bank 3820 comprising RMS measurement modules 3822*a* through 3822*n*, measures or estimates the power over each frequency band and supplies the respective power values to analysis module 3808. Analysis module 3808 determines (such as based on the received power values and frequency limits 3502) which frequency bands contribute the most to potential distortion. Analysis module 3808 sets the attenuation of frequency bands in the vulnerable range by attenuation bank 3830 which can comprise a digital scalar or variable gain amplifier such as 3832*a* through 3832*n*. The gain is set to 1 except for the offending frequency band(s) which is attenuated. Synthesis filter bank 3806 reassembles the signal to produce output signal 1304. The attenuation can employ attack and release times as discussed above.

Figure 39:
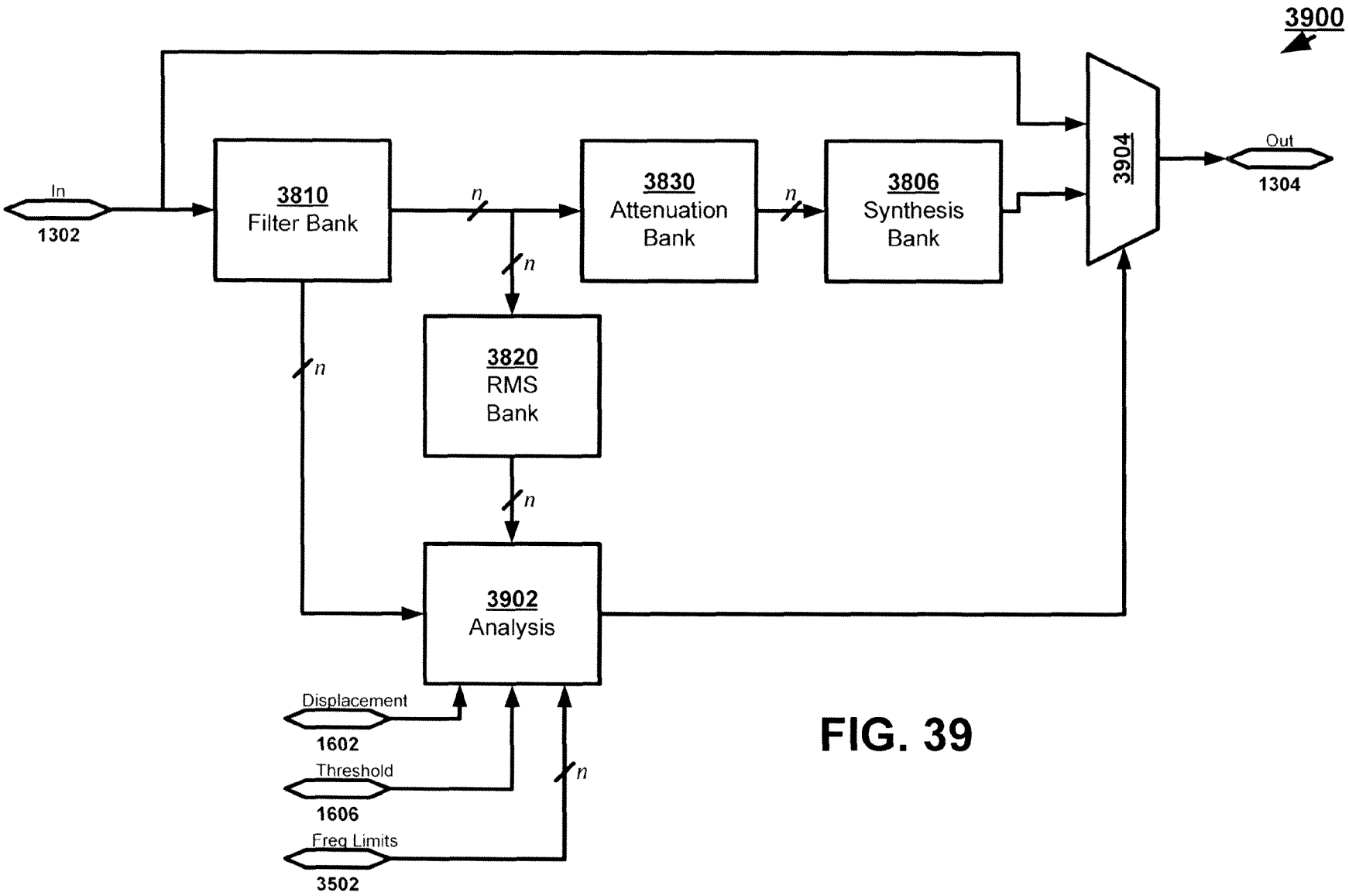
FIG. 39 shows an alternate embodiment of a distortion compensation module employing a filter bank.

FIG. 39 shows an alternate embodiment of a distortion compensation module employing a filter bank. Like distortion compensation module 3800, distortion compensation module 3900 comprises filter bank 3810, RMS bank 3820, attenuation bank 3830 and synthesis bank 3806 Analysis module 3902 determines (such as based on displacement value 1602 and threshold 1606) whether distortion would occur in an uncompensated signal. If not, then multiplexer 3904 allows input signal 1302 to pass unaltered and the compensation logic can be bypassed completely.

Figure 40:
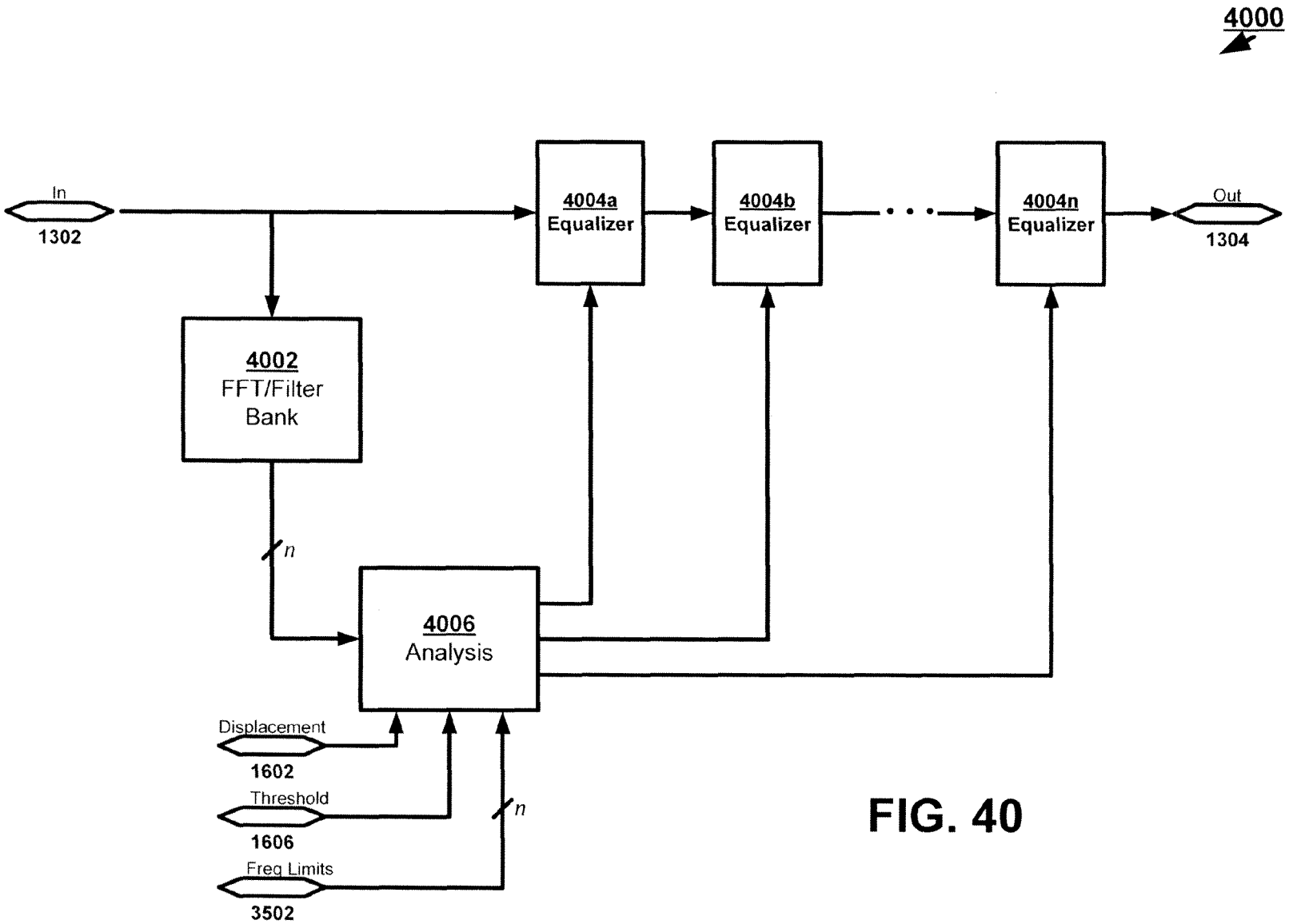
FIG. 40 shows an embodiment of a distortion compensation module employing dynamic equalization.

FIG. 40 shows an embodiment of a distortion compensation module employing dynamic equalization. Distortion compensation module 4000 comprises spectral power module 4002, one or more dynamic equalizers 4004*a* through 4004*n*, and analysis module 4006. Spectral power module 4002 can be an FFT such as described for distortion compensation module 3600 or a filter bank and RMS bank such as for distortion compensation module 3800. Regardless of the specific implementation, spectral power module 4002 measures or estimates the power of frequencies or frequency bands within a vulnerable range in input signal 1302. By comparing the measured frequency power levels with frequency limits 3502, offending frequencies can be identified. For each of these frequencies, a dynamic equalizer can be set to that offending frequency as its center frequency. The bandwidth as well as attack and release time of each of the equalizers can also be set.

Figure 41:
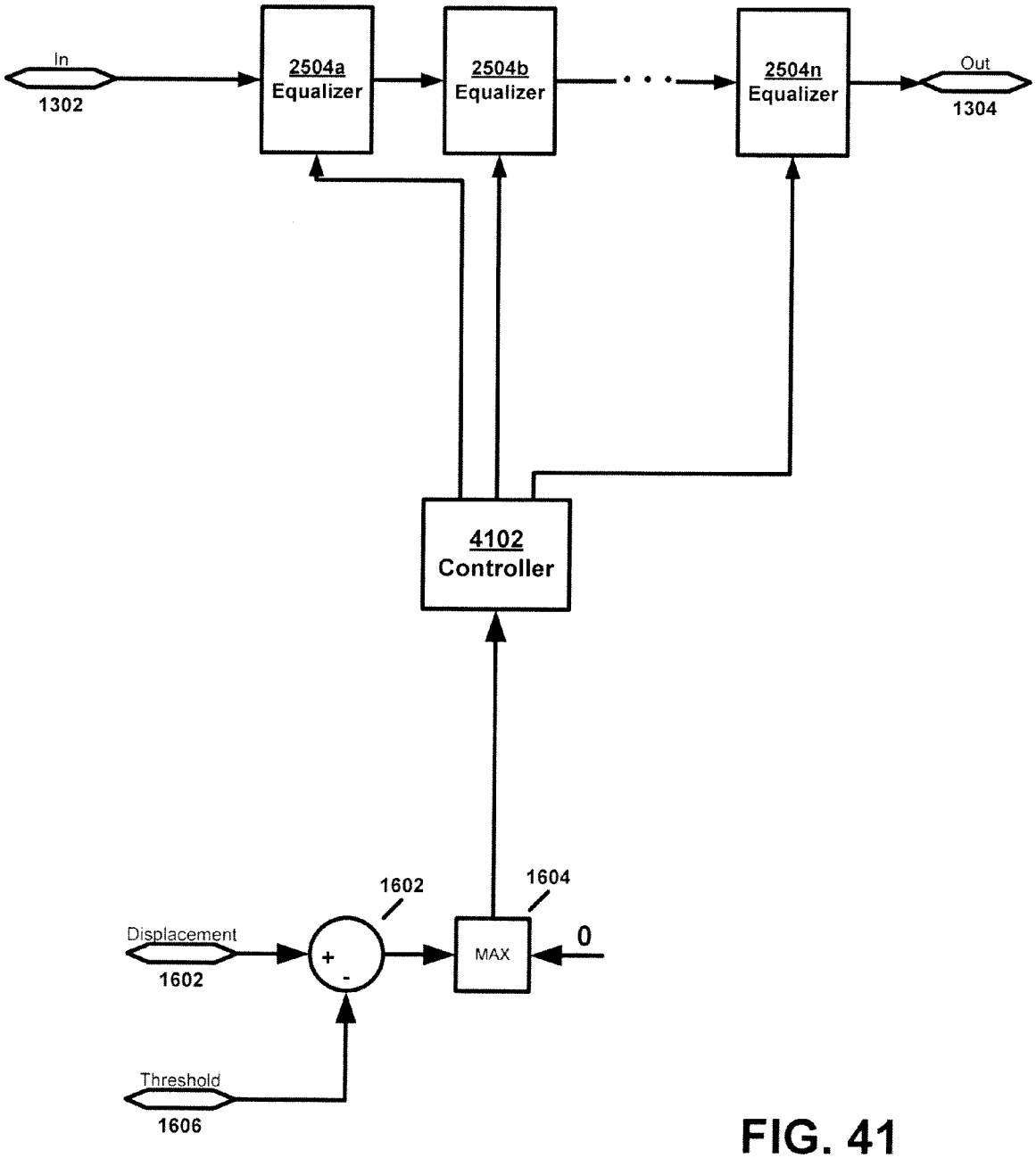
FIG. 41 shows an alternate embodiment of a distortion compensation module employing dynamic equalization.

FIG. 41 shows an alternate embodiment of a distortion compensation module employing dynamic equalization. Distortion compensation module 4100 comprises also comprises one or more dynamic equalizers 4004*a* through 4004*n*. However, the center frequencies and bandwidth are set by controller 4102 which receives an error signal derived from the maximum of zero and the difference between threshold 1606 and displacement value 1602 as computed by comparator 1602 and maximum function 1604. Controller 4102 uses error feedback to determine the center frequencies and optionally the bandwidths of each of the dynamic equalizers. Controller 4102 may also determine the attenuation factor of each dynamic equalizer. Controller 4102 can be a vectored controller taking a single input value, e.g., the error signal, and producing a vector output, e.g., center frequencies.

Figure 42:
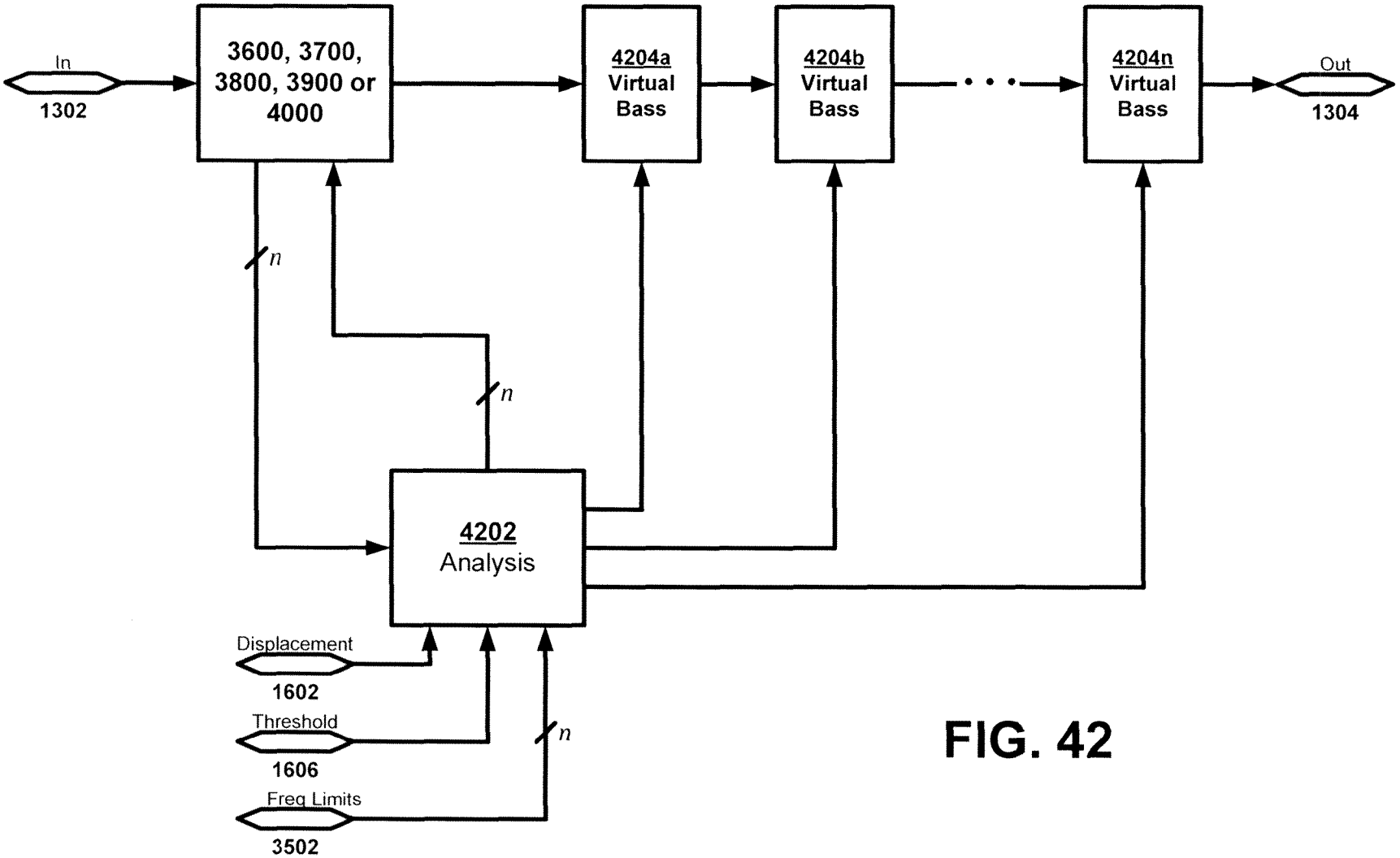
FIG. 42 shows an embodiment of distortion compensation module using virtual bass to boost the perceived loudness.

FIG. 42 shows an embodiment of distortion compensation module using virtual bass to boost the perceived loudness. Distortion compensation module 4200 is an augmentation of distortion compensation modules 3600, 3700, 3800, 3900, or 4000, which provide spectral information to analysis module 4202. Based on the frequencies that are suppressed, analysis module 4202 boosts perceived loudness through virtual bass modules 4204*a* through 4204*n*. Each virtual bass module boosts one or more harmonics of an offending frequency that has been suppressed. One method is to boost the natural harmonics by applying gain to the harmonics. Another method is to synthesize a signal at the harmonic frequency and insert the synthetic signal. Still another method is to isolate the offending frequency and shift it in frequency to one or more harmonic frequencies. Other suitable configurations can also or alternatively be used. For example, in FIG. 36, analysis module 3608 could be modified to shift the suppressed frequencies into their harmonics. Once in the frequency domain as provided by FFT 3602, the shifting operation can be performed in a very straightforward manner.

Figure 43:
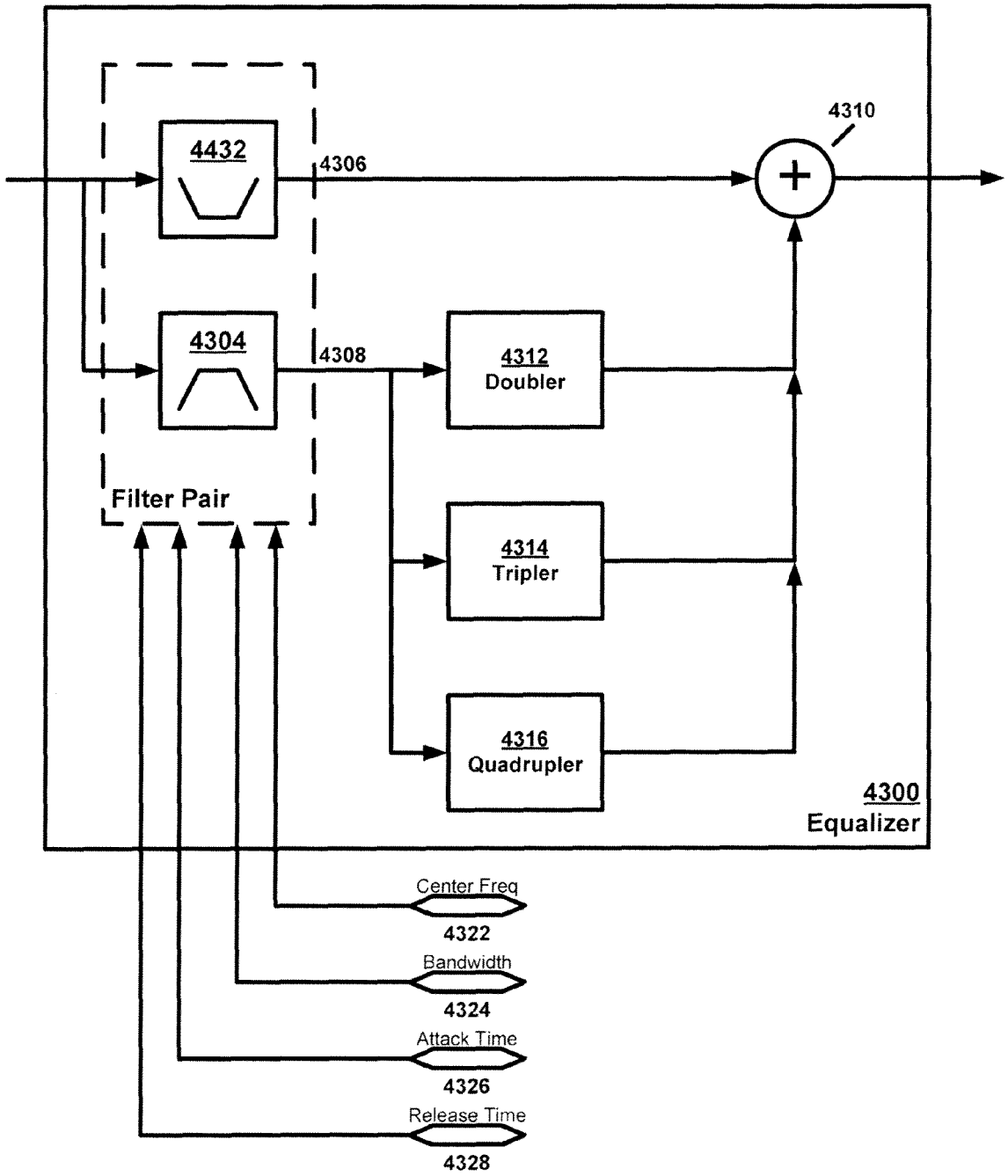
FIG. 43 shows an embodiment of a dynamic equalizer module with virtual bass.

FIG. 43 shows an embodiment of a dynamic equalizer module with virtual bass. Dynamic equalizer module 4300 can be used with equalizers 4004*a* through 4004*n*. A complementary filter pair comprising band stop filter 4302 and band pass filter 4304 extract a particular frequency band from an input signal. Signal 4306 has the frequency band suppressed. Extracted frequency band signal 4308 is shifted to double, triple and/or quadruple the frequency to produce a virtual bass signal which is inserted into signal 4306 with adder 4310. Frequency doubler 4312, tripler 4314, and quadrupler 4316 can be selectively activated. For example, if the center frequency of the equalizer is 300 Hz, but the vulnerable range is 200-800 Hz, doubling the frequency would still yield an offending frequency of 600 Hz. This harmonic could be suppressed or attenuated. However, it may be allowed to pass as it may not contribute as much to the displacement. The center frequency of the equalizer can be made adjustable as can the bandwidth of the filter pair. In addition, an attack and release time can also be implemented by dynamic equalizer module 4300. Center frequency input 4322 can be used to adjust the center frequency of the filter pairs. Bandwidth input 4324 can be used to adjust the bandwidth of the filter pair. Similarly attack time input 4326 and release time input 4328 can be used to adjust the attack and release time of the equalizer by adjusting the attack and release times of the filter pair.

Figure 44:
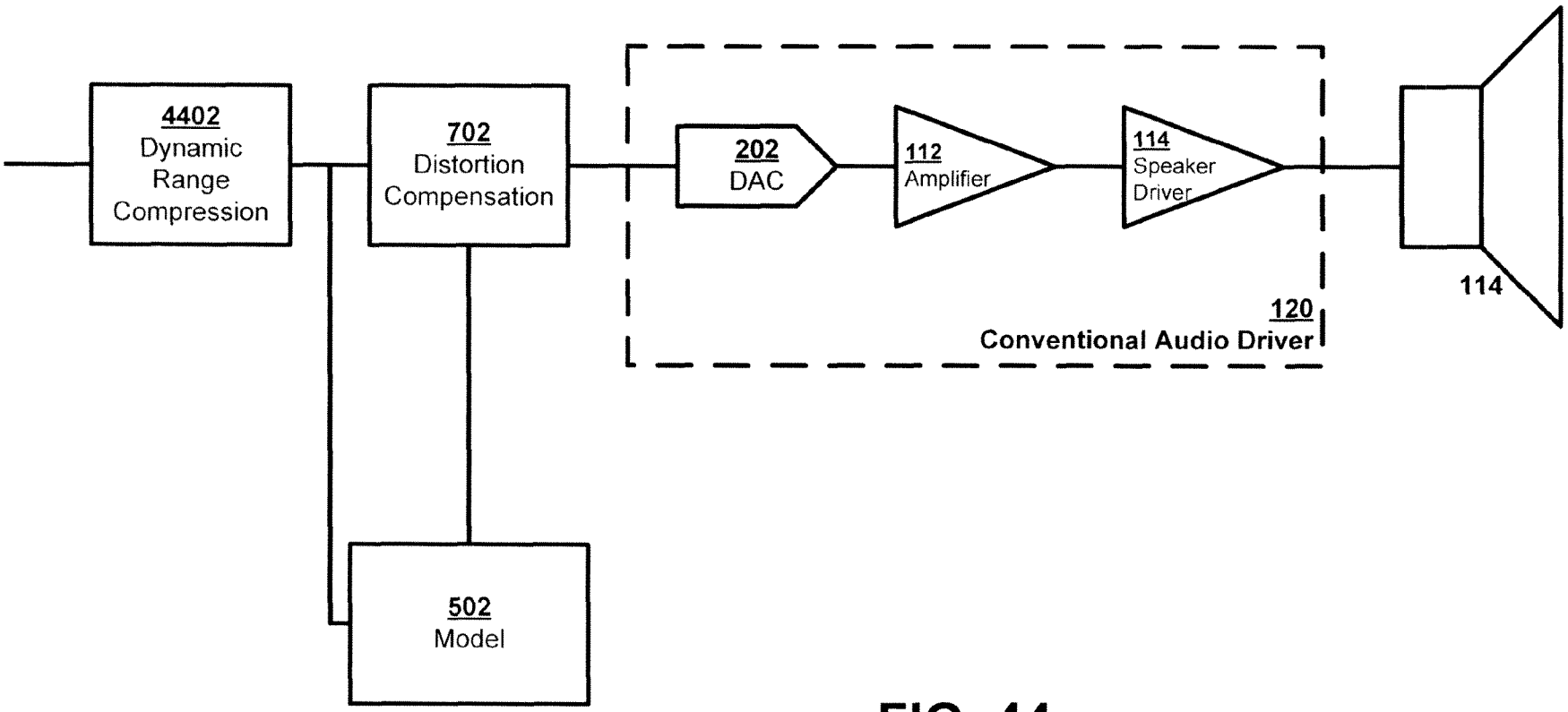
FIG. 44 discloses an embodiment of an audio driver using dynamic range compression to boost loudness.

FIG. 44 discloses an embodiment of an audio driver using dynamic range compression to boost loudness. Driver 4400 is similar to driver 700, but further comprises dynamic range compressor 4402 prior to distortion compensation unit 702. Dynamic range compressor 4402 applies a gain profile to the audio signal which increases the perceived loudness while suppressing peaks in the signal. A system similar to that described in FIG. 19 can be used. Dynamic range compressor 4402 adaptively determine the attenuation curve C(f) especially over a distortion prone frequency range. The attenuation curve sought should minimize the loss in loudness, $\Delta L$ given by equation (1). The cost function can also minimize the peaks at the same time.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A method for use in an audio system, the method comprising:

(a) selecting a frequency in a frequency range;

(b) selecting an amplitude from a plurality of amplitudes;

(c) causing a signal generator to generate a signal at the frequency and the amplitude;

(d) providing the signal to a loudspeaker to generate a sound;

(e) generating a sound signal representing the sound using a microphone;

(f) determining whether the sound signal has a distortion;

(g) if the determining determines that the sound signal does not have the distortion and if a last amplitude of the plurality of amplitudes has not been reached, selecting another amplitude of the plurality of amplitudes and repeating steps (c)-(g) until the determining determines that the sound signal has the distortion;

(h) recording, in response to determining that the sound signal has the distortion, the another amplitude causing the distortion as a minimum amplitude; and (i) filtering an audio signal utilizing the minimum amplitude.

2. The method of claim 1, wherein the determining whether the sound signal has a distortion comprises:

predicting an expected microphone signal based on the signals generated by the signal generator; and comparing the expected microphone signal with the sound signal representing the sound using the microphone.

3. The method of claim 2, wherein the expected microphone signal is predicted using a linear predictive filter.

4. The method of claim 1, wherein filtering the audio signal further utilizes recorded phases along with the minimum amplitude to create complex samples from the minimum amplitude and the recorded phases.

5. The method of claim 4 further comprising:

constructing a transfer function by fitting the complex samples to an infinite impulse response (IIR) filter; and inverting the transfer function to create an inverse transfer function.

6. An audio driver comprising:

a digital to analog converter (DAC);

an amplifier;

a signal generator; and an analysis module configured to:

(a) select a frequency in a frequency range;

(b) select an amplitude from a plurality of amplitudes;

(c) cause the signal generator to generate a signal having the frequency and the amplitude;

(d) determine whether the signal has the distortion;

(e) if the determining determines that the signal does not have the distortion and if a last amplitude of the plurality of amplitudes has not been reached, selecting another amplitude of the plurality of amplitudes and repeating steps (c)-(e);

(f) record, in response to determining that the signal has the distortion, the another amplitude causing the distortion as a minimum amplitude; and (g) filter an audio signal utilizing the minimum amplitude.

7. The audio driver of claim 6 further comprising:

a distortion compensation unit for receiving the signal; and a distortion model configured to determine if distortion exists in the distortion compensation unit.

8. The audio driver of claim 7 wherein the distortion model is coupled to an audio input or an audio signal output of the distortion compensation unit.

9. The audio driver of claim 7 wherein the distortion model utilizes speaker displacement to predict the distortion.

10. The audio driver of claim 9 further comprising a distortion detection unit coupled to a microphone, wherein the distortion detection unit generates revision data for the distortion model if the signal is determined to have the distortion.

11. The audio driver of claim 7 further comprising:

a resistor in series with a loudspeaker;

a differential amplifier operable to measure a voltage across the resistor; and a distortion detection unit operable to receive the measured voltage, wherein the distortion detection unit causes a revision in the distortion model if the signal is determined to have the distortion.

12. The audio driver of claim 7 further comprising a distortion detection unit operable to receive a signal proportional to a loudspeaker current, wherein the distortion detection unit causes a revision in the distortion model if the signal is determined to have the distortion.

13. The audio driver of claim 7 wherein the distortion compensation unit comprises a dynamic range compressor.

14. The audio driver of claim 7 wherein the distortion compensation unit comprises a gain element with an automatic gain control.

15. The audio driver of claim 7 wherein the distortion compensation unit comprises a look ahead peak reducer.

16. The audio driver of claim 7, wherein the distortion compensation unit comprises an adder operable to add a DC offset or a low frequency signal.

17. The audio driver of claim 7 wherein the distortion compensation unit comprises a PID controller.

18. The audio driver of claim 7 wherein the distortion compensation unit comprises a gain element with automatic gain control and an adder operable to add an offset or a low frequency signal.

19. The audio driver of claim 18 wherein the distortion compensation unit further comprises a PID control operable to control the adder and the gain element.

* * * * *